US011832704B2

(12) United States Patent
Shadduck

(10) Patent No.: US 11,832,704 B2
(45) **Date of Patent: *Dec. 5, 2023**

(54) COSMETIC APPLICATOR AND METHOD OF USE

(71) Applicant: John H. Shadduck, Menlo Park, CA (US)

(72) Inventor: John H. Shadduck, Menlo Park, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/049,411

(22) Filed: Oct. 25, 2022

(65) Prior Publication Data

US 2023/0270231 A1 Aug. 31, 2023

Related U.S. Application Data

(63) Continuation of application No. 17/302,528, filed on May 5, 2021, now Pat. No. 11,510,474.

(51) Int. Cl.

| | |
|---|---|
| ***A45D 33/34*** | (2006.01) |
| ***A45D 40/26*** | (2006.01) |
| ***A45D 34/04*** | (2006.01) |

(52) U.S. Cl.

CPC ..... *A45D 33/34* (2013.01); *A45D 34/04* (2013.01); *A45D 40/26* (2013.01); *A45D 2200/1009* (2013.01)

(58) Field of Classification Search

CPC .... A45D 33/005; A45D 33/006; A45D 33/34; A45D 33/36; A45D 34/04; A45D 34/041; A45D 40/26; A45D 40/262; A45D 40/28; A45D 2200/1009; A45D 2200/1018; A45D 2200/1036; A45D 2200/1045; A45D 2200/1054; A45D 2200/1063; A47L 13/16; A47L 13/17; A47K 7/02; A47K 7/03; B08B 1/001; B08B 1/003; B08B 1/006

USPC ..... 15/104.93, 104.94, 208, 209.1, 210.1, 15/229.14, 244.1, 244.3, 244.4; 132/320; 383/3

See application file for complete search history.

(56) References Cited

U.S. PATENT DOCUMENTS

| | | | |
|---|---|---|---|
| 1,439,734 | A | 12/1922 | Guinzburg |
| 2,198,698 | A | 4/1940 | Fitzmeyer |
| 2,357,446 | A | 9/1944 | Bendar |
| 2,836,529 | A | 5/1958 | Morris |
| 3,059,262 | A | 10/1962 | Marschner |
| 3,279,986 | A | 10/1966 | Hyman |

(Continued)

FOREIGN PATENT DOCUMENTS

JP 2012-085853 5/2012

OTHER PUBLICATIONS

Duan, G. et al., "Ultralight, Soft Polymer Sponges by Self-Assembly of Short Electrospun Fibers in Colloidal," *Advanced Functional Materials*, 25(19), pp. 2850-2856, Mar. 30, 2015.

(Continued)

*Primary Examiner* — Randall E Chin
(74) *Attorney, Agent, or Firm* — Levine Bagade Han LLP

(57) ABSTRACT

Cosmetic applicators, blenders and aids, and more particularly to a resilient blender that includes an open-cell memory foam surface component that is easily cleanable or disposable in combination with a resilient core component. Further, the core component of the system includes a spring structure for greatly accelerating the rebound of the blender surface from a compressed state to a repose memory or de-compressed state.

18 Claims, 20 Drawing Sheets

(56) References Cited

U.S. PATENT DOCUMENTS

| | | | |
|---|---|---|---|
| 3,337,895 | A | 8/1967 | Clements |
| 3,568,236 | A | 3/1971 | Aston |
| 3,955,233 | A | 5/1976 | Nakamura |
| 6,006,761 | A | 12/1999 | Meledandri |
| 6,154,914 | A | 12/2000 | Suzuki et al. |
| 11,019,906 | B2 | 6/2021 | Tammel et al. |
| 11,122,879 | B1 | 9/2021 | Tammel et al. |
| 11,510,474 | B1 | 11/2022 | Shadduck |
| 2018/0070700 | A1 | 3/2018 | Choi |
| 2018/0360194 | A1 | 12/2018 | Cho et al. |
| 2019/0059548 | A1 | 2/2019 | Chaillet-Piquand et al. |
| 2019/0159572 | A1 | 5/2019 | Tarajano |
| 2020/0170379 | A1 | 6/2020 | Bickford et al. |
| 2020/0187623 | A1 | 6/2020 | Tammel et al. |
| 2021/0282533 | A1 | 9/2021 | Tammel et al. |
| 2022/0053909 | A1 | 2/2022 | Tammel et al. |
| 2022/0354232 | A1 | 11/2022 | Shadduck |

OTHER PUBLICATIONS

Haerst, M. et al., "Silicone Fiber Electrospinning for Medical Applications," 6th European Conference of the International Federation for Medical and Biological Engineering Proceedings, vol. 45, pp. 537-540, 2015.

COSMETIC APPLICATOR AND METHOD OF USE

CROSS-REFERENCE TO RELATED APPLICATION INFORMATION

This application is a continuation of U.S. patent application Ser. No. 17/302,528 filed May 5, 2021, now U.S. Pat. No. 11,510,474, the content of which is incorporated herein by reference in its entirety.

BACKGROUND OF THE INVENTION

1. Field of the Invention

The present invention relates to cosmetic applicators, blenders, and aids, and more particularly to a resilient blender that includes an open-cell memory foam surface component that is easily cleanable or disposable in combination with a resilient core component. Further, the core component of the system includes a spring structure for greatly accelerating the rebound of the blender surface from a compressed state to a repose memory or de-compressed state.

2. Description of the Background Art

Professional makeup artists often work in fast-paced environments where there is a need to apply makeup to several models or actors in rapid succession, particularly in the fashion, theatre and television industries. Such makeup artists may spend a considerable amount of time cleaning and preparing their makeup tools when working with multiple clients over a short period of time. With the advent of new technologies in high-resolution digital cameras and video, there is an increasing need for professionally blended face and body makeup.

Cosmetic applicators known as makeup sponges or blenders are well known and are a mainstay of a makeup artist's toolkit. The commercially available makeup sponges or blenders typically consist of a latex or urethane foam sponge 50, as shown in FIG. 3, wherein the sponge consists of a uniform density open cell foam and may have a variety of shapes and sizes.

There are several disadvantages involving the use of the currently available sponges and blenders. In normal use, a sponge or blender is dabbed continuously against the recipient's skin where cosmetic materials are picked up by open cells of the blender surface and then released back onto the skin surface as the blender is moved to thus blend the cosmetic material.

First, many blenders during use are impregnated with large amounts of cosmetic material, which can be wasteful and costly. If too much cosmetic material is impregnated in the applicator, it may be difficult to blend the cosmetic material uniformly. On the other hand, if the amount of cosmetic material retained by the applicator is too small, then blending may take longer and still may not be uniform. The designs of blenders have been adjusted to improve the amount of cosmetic material impregnated into the sponge surface during use, mainly by experimenting with the size and density of pores in the open cell foam that comprises the blender. Typically, the open cell foam blenders that are commercially available have very small pores which are adapted to hold water before use to moisturize the sponge. In use, the dabbing motion can cause the cosmetic material to migrate through the entire sponge. Thereafter, cleaning the sponge is problematic as the makeup material can migrate throughout the sponge. Further, the complete drying of such blender sponges can take hours due to the very small pore size in such blenders.

Further, from the viewpoint of hygiene, bacteria can easily grow inside the pores of the blender, especially when liquid cosmetic material is applied, because the material can permeate through the entire foam body of the applicator.

Another potential disadvantage of currently available open cell foam blenders relates to their use with anticipated new forms of makeup materials, some of which are being contemplated, which may be termed herein as microbiome cosmetics. While not widely used today, it is anticipated that makeup materials such as primers, etc. will be used that carry living microorganisms, i.e., the microbiome. When using an open cell blender after the application of microbiome cosmetics, it will be inevitable that such living microorganisms will migrate throughout the sponge, which again may make thorough cleaning and drying more important. Further, it is possible that such applicators would require regulatory clearance for sterilization when used to apply microbiome materials to a recipient's face.

An additional disadvantage of current open cell foam blenders relates to the uniformity of the resilient open cell foam material and the slow rebound of such memory foams from a compressed or tensioned state to its repose memory shape. In use, a makeup artist also could find it useful to have different density foams with different force/compression characteristics for blending in different areas of a recipient's face, for example, softer foam for use around the eyes and less soft foam for use in other locations. Further, it would also be very useful to have faster rebounding foam which could speed up the blending of makeup.

What is needed is:

- a cosmetic applicator or blender configured for very rapid cleaning and drying after each use to provide for completely hygienic makeup applications;
- a cosmetics applicator or blender with a surface topology and porosity suited for blending makeup without excessive impregnation of the makeup into the applicator to limit waste of cosmetic materials;
- a cosmetics applicator or blender adapted for use with microbiome cosmetics which carries limited volumes of such live cultures to conserve expensive products and that is easily cleanable or sterilizable;
- a cosmetics applicator or blender with a surface structure adapted to absorb a specific amount of water to allow for consistent levels of moisture in the applicator for specific types of makeup;
- a cosmetics applicator or blender for makeup artists that can be inexpensive and adapted for single use that has all needed features for controlled moisture content, feel on the skin, and adapted for limiting waste of cosmetic materials;
- a cosmetics applicator or blender that provides a makeup-carrying surface with much faster rebound characteristics for speeding up the blending of makeup materials; and
- a cosmetics applicator or blender with at least two different surface portions with different force/deformation characteristics for differential blending/dabbing with a single applicator.

The several variations of the present invention described below provide a cosmetics applicator or blender that solves the aforementioned problems.

SUMMARY OF THE INVENTION

The features described herein include various novel details of construction and combinations of parts, and other advantages, will be described with reference to the accompanying drawings and claims. It is understood that the particular methods and devices conveying the inventive features are shown by way of illustration and not as a limitation of the invention. The principles and features of this invention may be employed in various and numerous embodiments without departing from the scope of the invention.

The present disclosure includes improved cosmetic applicators. For example, such an applicator can include a resilient body shaped for gripping by a user, including but not limited to fingers of the user, a surface portion of the resilient body comprising a fluid permeable material having a first resilient characteristic; and a core component of the resilient body including a spring structure for imparting to the resilient body a second resilient characteristic to enhance rebounding the resilient body from a compressed tensioned shape to a de-compressed repose shape, where the spring structure is selected from a group consisting of at least one interior chamber, a woven material, a braided material and an entangled filament material.

The variation of the applicator can include wherein a spring structure comprises a plurality of interior chambers or cells. In additional variations, the spring structure can comprise a NiTi material. Alternatively, or in combination, the spring structure can comprise a polymer. The applicator described herein can further comprise a fluid impermeable layer intermediate to the surface portion and the core component. In additional variations, the surface portion is removable from the core component. Additionally, the fluid impermeable layer can be carried by the surface portion.

The cosmetic applicator of claim described herein can also include a portion of the resilient body that is configured for finger-actuated manipulation to alter a shape of the at least one interior chamber to thereby adjust compressibility and rebound characteristics of the resilient body.

In an additional variation, cosmetic applicators can further define an opening in an end of the resilient body adapted to position over a rotatable shaft for spin-drying the resilient body.

Another variation of a cosmetic applicator can include a resilient applicator body adapted for gripping by a user; a surface portion of the resilient applicator body comprising a fluid permeable resilient foam material adapted for tissue contact; a core portion of the body including at least one interior chamber at least partially surrounded by an elastomeric wall; and where a portion of the body is configured for finger-actuated manipulation to alter a shape of the at least one interior chamber to thereby adjust compressibility and rebound characteristics of the resilient applicator body.

Another variation of a cosmetic applicator can include a resilient body having a central axis adapted and shaped for gripping with the fingers of a user; a surface portion of the body comprising a fluid permeable layer overlying a fluid impermeable layer; an interior portion of the body including at least one spring element for imparting to the body a selected rebound parameter for rebounding the body from a compressed tensioned shape to a de-compressed repose shape.

A variation of the cosmetic applicator can include a configuration where the second rebound characteristic consists of a second rebound rate that is faster than a first rebound rate of the first inherent rebound characteristic. For example, the second rebound rate can be faster than the first rebound rate by at least 1.5 times, at least 2 times, at least 3 times, or at least 5 times.

In another variation, the cosmetic applicator is configured such that the surface portion is detachably coupled to the core portion. Alternatively, the surface portion can be fixed to the core portion.

In another variation, an interface between the surface portion and the core portion is fluid impermeable.

Variations of the cosmetic applicator can include a ratio of a total interior volume of the surface portion of memory foam relative to a spatial volume of the resilient body is less than 0.4:1, less than 0.3:1, less than 0.2:1 or less than 0.1:1.

Variations of the device include applicators where the at least one spring element comprises a helical spring. Alternatively, or in combination, the at least one spring element comprises a plurality of spring elements.

The cosmetic applicators described herein can include a plurality of spring elements. In another variation of the device, the plurality of spring elements is spaced apart about said central axis. In additional variations, the plurality of spring elements is asymmetrically spaced apart about said central axis. Alternatively, the spring elements can differ in orientation relative to the central axis. The spring elements can vary in terms of spring elements differ in spring strength or spring constant.

Another variation of a cosmetic applicator includes a resilient compressible body having a central axis adapted and shaped for gripping with the fingers of a user, the body having a first compressibility parameter when compressed about the central axis and a second compressibility parameter when compressed at an angle relative to the central axis.

In another variation, the cosmetic applicator includes a body that has at least a third compressibility parameter when compressed at a different angle relative to the central axis.

Variations of cosmetic applicators described herein can include an electrospun fiber sponge and/or an electrospun silicone sponge. In some cases, the electrospun fibers have a diameter less than 50 μm or less than 20 μm.

This application is commonly assigned with U.S. patent application Ser. No. 16/715,971 filed Dec. 16, 2019, now U.S. Pat. No. 11,019,906, which is a non-provisional application of United States Provisional Application No. 62/780,657 filed on Dec. 17, 2018. The entirety of each of which are incorporated by reference herein.

BRIEF DESCRIPTION OF THE DRAWINGS

In order to better understand the invention and to see how it may be carried out in practice, some preferred embodiments are next described, by way of non-limiting examples only, with reference to the accompanying drawings, in which like reference characters denote corresponding features consistently throughout similar embodiments in the attached drawings.

DESCRIPTION OF THE INVENTION

Figure 1:
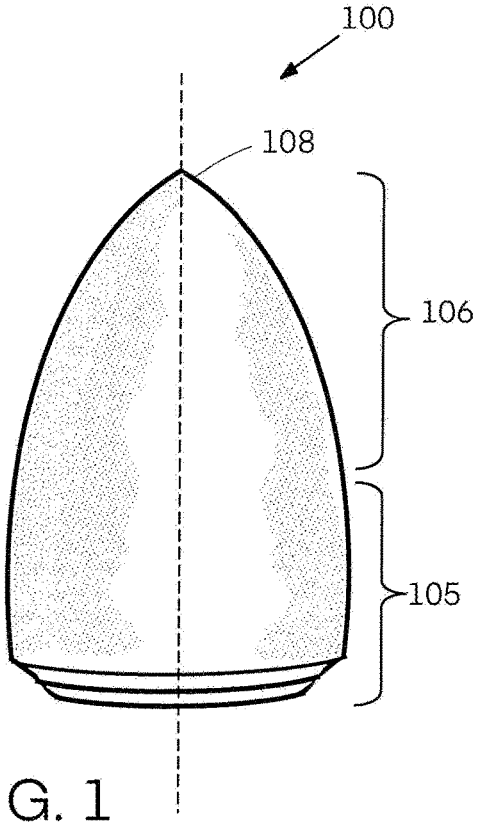
FIG. 1 is a perspective view of a cosmetic applicator or blender corresponding to the invention.
Figure 3:
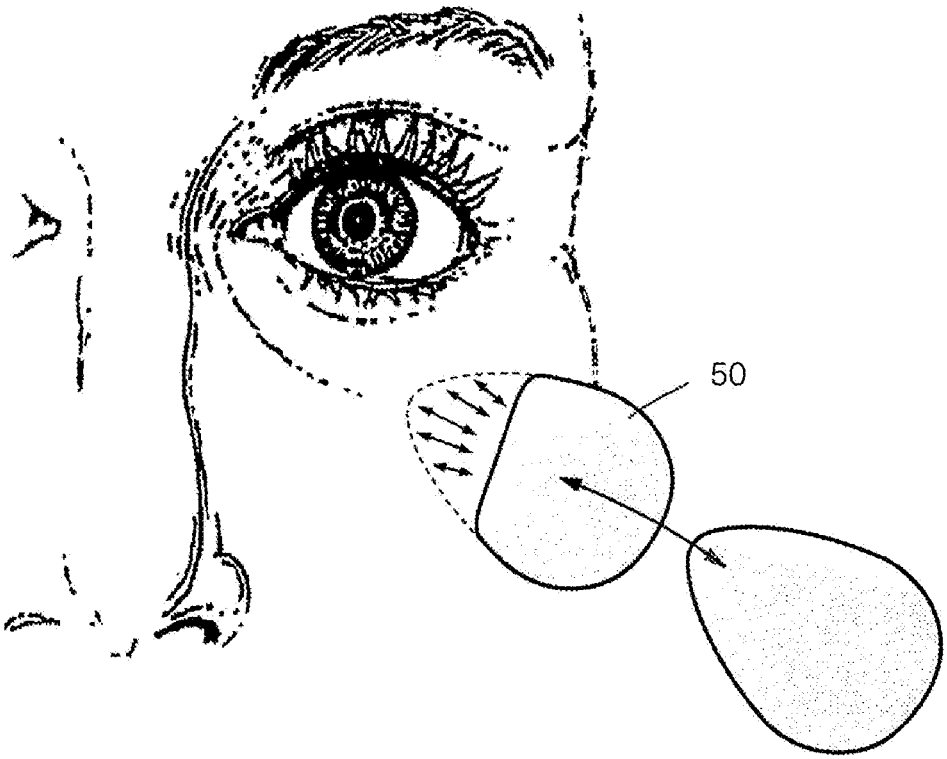
FIG. 3 (PRIOR ART)
FIG. 3 is a schematic view of a method of using a prior art sponge blender in dabbing cosmetic materials on a recipient's skin.

FIG. 1 shows a cosmetics applicator, tool or blender 100 corresponding to the invention, which is adapted for gripping with a user's fingers and then typically used in a dabbing or stippling motion to blend and apply cosmetic materials to a recipient's face (cf. FIG. 3). The shape and contours of the blender can vary and in one embodiment shown in FIG. 1, the applicator has a proximal portion 105 that is generally gripped with the user's fingers and a distal portion 106 that tapers to a rounded or sharp apex 108. The blender or applicator of FIG. 1 comprises a soft, compressible, resilient body, as can be easily understood. While the blender of FIG. 1 is rounded and tapers to distal apex 108, various flat, polygonal and planar variations are possible. The length dimension of the applicator 100 may range from about 20 mm to 60 mm but any dimensions are possible for different makeup blending purposes. Other shapes are described in additional embodiments below.

Figure 2A:
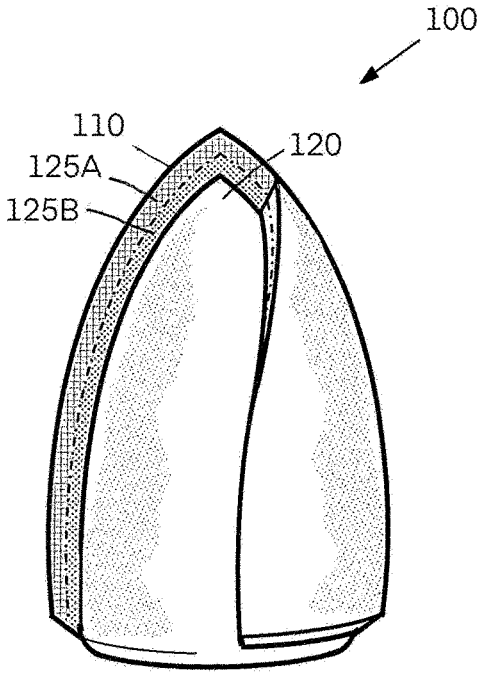
FIG. 2A is a perspective cut-away view of the blender of FIG. 1 showing an open cell surface component is removable from the fluid impermeable core component.
Figure 2B:
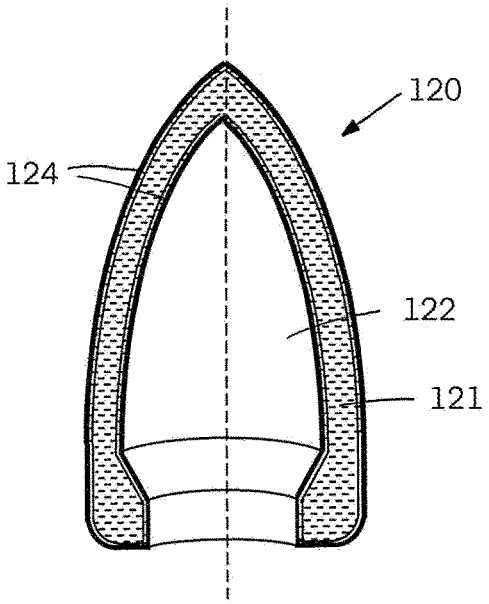
FIG. 2B is a sectional view of the resilient core component of the blender of FIGS. 1 and 2A showing an open interior space in the core component.

In FIG. 2A, it can be seen that the cosmetics applicator or blender 100 of FIG. 1 has a surface component or portion that 110 that comprises a soft, resilient open cell structure and typically is an open cell foam or sponge, often called a memory form. In other variations, at least a portion of the surface component 110 can comprise other open cell structures such as a microfabricated polymer or a layer electrospun fibers as will be described below. The surface component 110 interfaces with the core component or portion 120 of the blender 100, which also is soft and resilient. As can be seen in FIG. 2B, the core component 120 in one variation is an open cell foam 121 with open interior space 122. In this variation, the surfaces of the core component 120 comprise a fluid impermeable layer 124 (FIG. 2B). In other variations described below, the core component 120 can comprise a body or structure that is a foam block without the interior open space and is configured with the same compressibility and resilient characteristics with fluid impermeable surface layer.

Now referring to FIG. 2A, in one variation, the open cell surface component 110 comprises a first outer layer 125A and the second inner layer 125B which have different dimensions of the open cell structure and may also differ in material characteristics such as hydrophobicity. The first outer layer 125A is configured with open cells that have a selected dimension adapted to receive, carry and blend makeup materials therein as the blender surface is used in a dabbing fashion against the user's skin as shown in FIG. 3. In one variation, the first outer layer 125A can have a thickness of 0.2 mm to 5.0 mm a more often from 0.5 mm to 2.5 mm. The mean dimension of open cells in the outer layer 125A can range between 100 μm and 500 μm.

Still referring to FIG. 2A, this variation of blender 100 has a second inner layer 125B of the surface component 110 that comprises an open cell structure adapted to carry water in a selected volume to provide moisture for applying or blending makeup material carried transiently by the first outer layer 125A when dabbed the recipient's skin as described above. In one variation, the second inner layer 125B can have a thickness of 0.5 mm to 10.0 mm and more often from 2.0 mm to 5.0 mm. The mean dimension of an open cell in the second inner layer can range between 5 μm and 250 μm. In the embodiment illustrated in FIG. 2A, the mean dimension the open cells in the second inner layer 125B are significantly smaller than the mean dimension of the open cells in the first outer layer 125A, as the inner layer is configured to allow for the free flow of water through both the first and second layers 125A, 125B. However, the smaller open cells of inner layer 125B are adapted to reduce or prevent the migration of makeup materials (powder or fluid) through the first outer layer 125A and into the second inner layer 125B. In some variations, the second inner layer 125B is designed with very small open cell dimensions that can receive water but entirely prevent the movement of makeup material into such open cells. As described above, the outer surface layer 124 of the core component 120 is fluid impermeable so that any fluid absorption and makeup migration is prevented following material and fluid impregnation of the surface component 110.

Further, still referring to FIG. 2A, the material of the second inner layer 125B can be a hydrophobic material, which will accept the migration of water therein but has the tendency the repel retained water which then assists in moving water droplets outward through the surface component 110, for example, when the blender is squeezed. Silicone is an example of a hydrophobic material that can be used in the second inner layer 125B. In contrast, in one variation, the first outer layer 125A can be a substantially hydrophilic foam material that does not resist carrying small amounts of water or makeup fluids therein.

Thus, it can be understood from FIGS. 1 and 2A, the open cell surface component 110 comprises only a small fraction of the entire cubic volume of the applicator 100 when in its repose or non-compressed shape as shown in FIGS. 1 and 2A. In one aspect of the invention, the open cell component 110 is less than 40% of the total spatial volume of the applicator or blender 100. More often, the total volume of the open cell component is less than 30% of the total spatial blender volume or less than 20% of the total spatial volume. In the embodiment shown in FIG. 1, the open cell component is less than 10% of the total spatial blender volume. The term spatial volume as used herein means the total volume of the spatial "envelope" defined by the blender without regard to the open interior space. The term total volume of the open cell component means the actual physical volume of such a component and not the volume of the envelope defined by the component.

Stated another way, in another aspect of the invention, it has been found that the retained water volume carried by the open cell structure (surface component) can be less than 20 mL or less than 10 mL and still provide adequate moisture for dabbing or blending of makeup. In contrast, prior art makeup sponges or blenders typically retain far greater volumes of water since the entire applicator is an open cell foam. Such applicators that retain significantly larger water volumes are undesirable since cleaning and drying such sponge-type applicators is time-consuming and may result in mold and bacteria growth in the sponge material if not properly cleaned and dried.

As can be understood from FIGS. 2A and 2B, after use, the outer blender component 110 can be removed from the core component 120. In one aspect of the invention, the makeup artist can simply dispose of the outer component 110 as it can be expensive. In another aspect of the invention, the makeup artist can clean, rinse, and dry the outer component 110, which can be accomplished very quickly since there is a limited volume of open cell material that can carry water and makeup materials. The outer component 110 can be washed under a faucet and then also can be dried rapidly after squeezing out any water, since the outer component has a very limited volume of open cells and air can be exposed all sides of the component 110.

Figure 4:
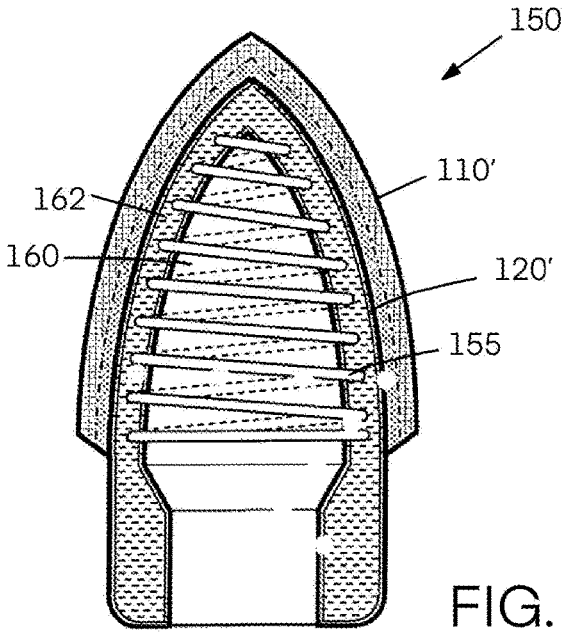
FIG. 4 is a sectional view of another variation of blender similar to that of FIGS. 1-2B with a core component carrying an exemplary spring structure that is configured (i) to provide more rapid rebound during use to speed up the blending of cosmetic materials, and (ii) to provide a directional orientation to the blender's rebound to control and simplify the blending of cosmetic materials.
Figure 5A:
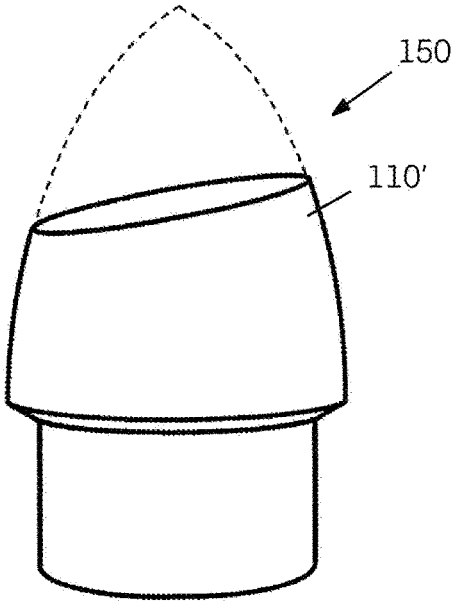
FIG. 5A is a perspective view of the blender of FIG. 4 showing the distal end of the blender or applicator partially compressed as when dabbing against a recipient's skin.

Now turning to FIG. 4, another variation of blender 150 is shown, which can be used to apply and blend cosmetic materials as described above. In this variation, the surface component 110' of the blender can be similar to the embodiment of FIGS. 1-2B. The core component 120' again has the same functionality as shown in FIGS. 2A-2B, except the resilient structure has a different configuration that is adapted to greatly alter the resilient characteristics of the core component 120'. More in particular, in this variation, the core component 120' includes a resilient spring structure within a foam body which greatly amplifies the speed of the rebound of the blender from a deformed, tensioned state (FIGS. 5A-5B) to its memory, untensioned state (FIG. 4) which occurs repeatedly as the user dabs and blends the cosmetic materials. In one variation shown in FIGS. 5A-5B, the spring structure can comprise a metal helical spring 155 of a wire or ribbon spring steel, Nitinol or the like. As can easily be understood, a metal spring such as a helical spring 155 of FIG. 4 can rebound the tensioned shape much faster than a memory foam. In one variation, it is believed the spring 155 can rebound from the tensioned state at least five times faster than a memory foam, or least two times faster. As also can be understood, the spring 155 of FIG. 4 can be deformed sideways to a certain extent as well as being compressed vertically about the axis 158 of the spring 155. It should be appreciated that other spring structures may be used for similar purposes, such as a plurality of helical springs or other non-helical forms of spring material. Such spring structures also include metal wires or polymeric materials, braided materials and the like. Thus, the core component 120' of FIG. 4 functions in the same manner as a memory foam core but can rebound far faster which can speed up the method of blending cosmetic materials.

In one variation shown in FIG. 4, it can be understood that the core component 120' has an open space 160 within the core. Further, the spring structure can be embedded within a foam element 162, but also can be carried in a sleeve element or can be a free-standing spring. In this aspect of the invention, the cleaning and drying of blended is again simplified since there is no large block of open cell foam as in prior art blenders.

A further advantage of the embodiment of FIG. 4 is that the blender core component 120' can be configured to collapse axially to be carried in a collapsed and reduced volume in a flat container. In many cases, users would find it advantageous to have a blender that can be carried in a flattened shape, for example, for carrying in a user's purse or makeup kit.

Figure 5B:
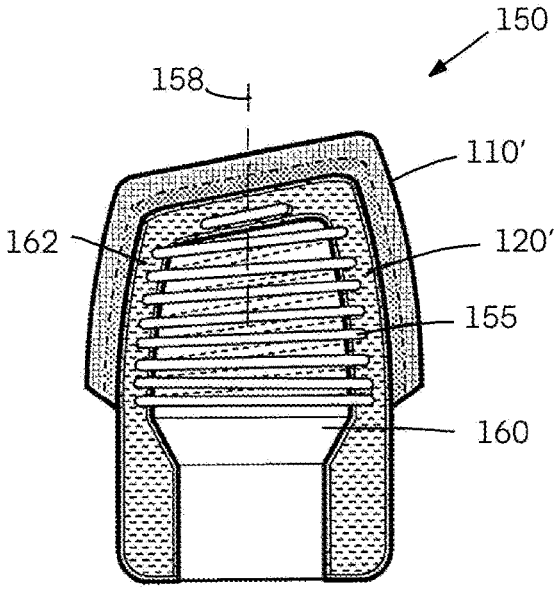
FIG. 5B is a sectional view of the blender of FIG. 5A showing the interior spring structure when partially compressed.

In the variation of FIGS. 4-5B, it should be appreciated that blenders of the type shown can be provided in a kit with a single core component 120' and a plurality of surface components 110' wherein each such surface component 110' differ from one another. It can be understood that the surface component 110' is inexpensive and optionally disposable or designed for a limited number of uses. Such a surface component 110' can be inexpensive if made in a single material or slightly more expensive if fabricated with two layers as described above. In the event, a blender kit could have two or more surface components 110' that differ in thickness, density, porosity, moisture volume, moisture retention, hydrophobicity and other characteristics and the user can select among the optional surface components for particular makeup blending applications or based on personal preference. It has been found that cosmetic materials have various fluidic properties and particle dimensions and may be more easily blended with more or less moisture in the surface component 110'. The kit can also provide a graphic reminder of the particular service component 110' by making each service component a different color or having names, numbers or other characters on the component for viewing by the user.

Figure 6:
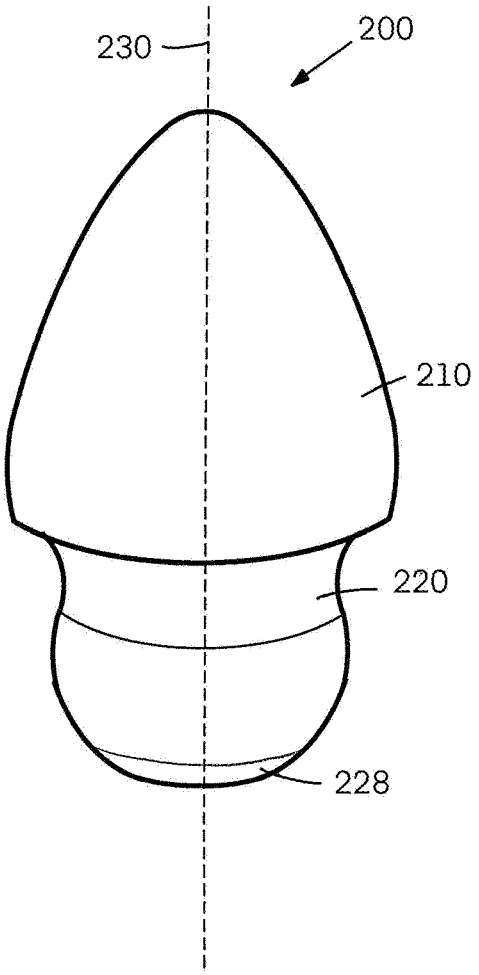
FIG. 6 is a perspective view of another variation of blender similar to that of FIGS. 4-5B with a grip portion that is spaced apart from the open cell foam component.
Figure 7:
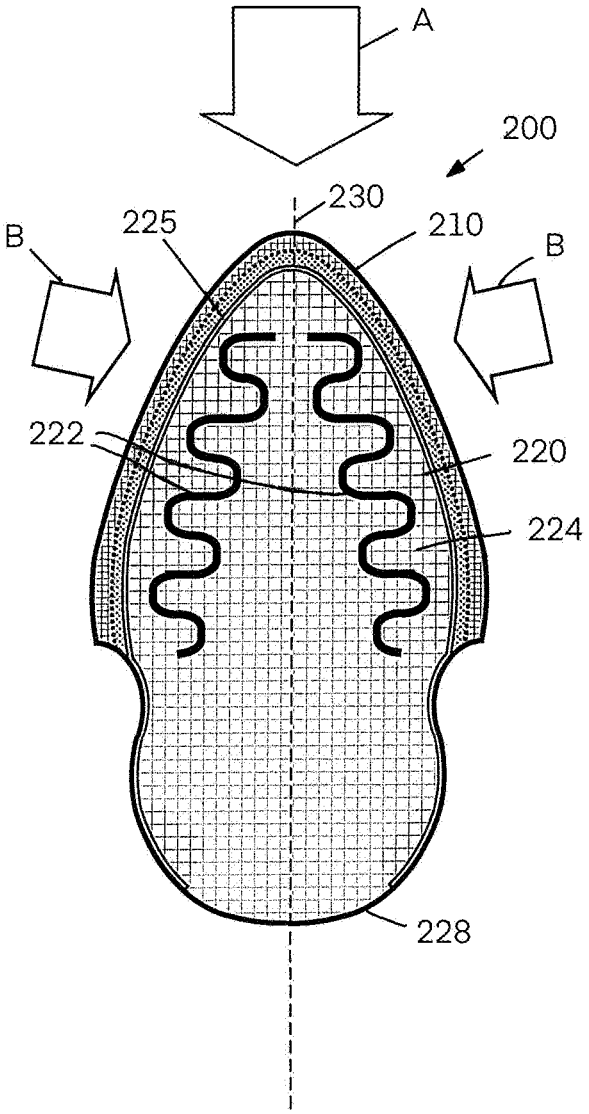
FIG. 7 is a sectional view of the blender of FIG. 6, showing the core component of an open-cell foam carrying a different form of spring structure.

Now turning to FIGS. 6-7, another variation of blender 200 is shown, which is somewhat similar to the embodiment of FIGS. 4-5B. In this variation, the sectional view of FIG. 7 shows the surface component 210 and the core component 220, which has a plurality of spring elements 222 embedded therein. The core component 220 can be an open cell foam block 224. As described above, a fluid impermeable layer 225 is provided at the interface between the core component 220 and the surface component 210. In order for the core component 220 to be compressed, it is obvious that a portion of the core 220 and foam block 224 must be exposed to the exterior environment to allow airflow out of and into the open cell core. Thus, as can be seen in FIG. 7, a proximal portion 228 of the core component 220 and foam block 224 is exposed without the fluid impermeable layer 225. In order to allow for rapid airflow into and out of the core component, the exposed surface area indicated at 228 must be sufficiently large to allow for rapid compression and de-compression of the core 220. For this reason, the exposed surface area should be at least 5 $mm^2$ or at least 10 $mm^2$.

Of particular interest, the variation of FIGS. 6-7 has a different form of spring structure where a plurality of springs 222 or attached spring elements are spaced out around the central axis 230 of the blender. The individual spring elements 222 are designed to respond to deflection both axially and transverse to the axis in different manners. For example, it would be advantageous to provide a first selected force/deformation characteristic about the axis 230 and the second selected force/deformation characteristic and angular transverse to the axis 230. This will allow the user to dab axially with first deformation and response characteristics, and then to switch used to dab sideways with second information in response characteristics. It has been found that different deformation and response parameters are useful for different area of the recipient's skin surface. For example, it may be better to use a softer deformation and response portion of the blender around the recipient's eyes, and then a stronger deformation and response portion around other portions of the recipient's face. Thus, the single blender 200 can be used in two different vectors depending on the user preference, with arrows A and B in FIG. 7 indicating two different directions of dabbing, which provide the first and second response characteristics.

Figure 8:
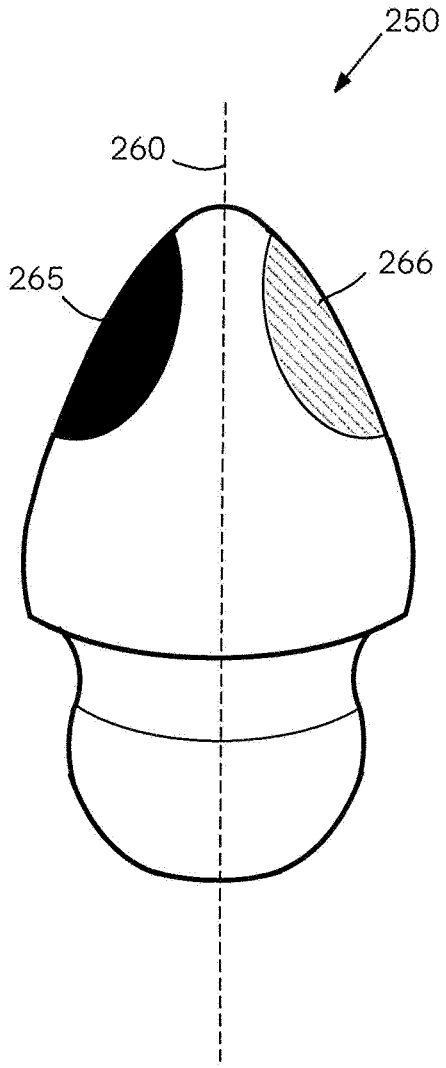
FIG. 8 is a perspective view of another variation of blender similar to that of FIGS. 6-7 except having an asymmetric internal spring structure for providing different force/deformation characteristics at various surface portions, and graphic indicators on the blender surface indicating the different surfaces.
Figure 9:
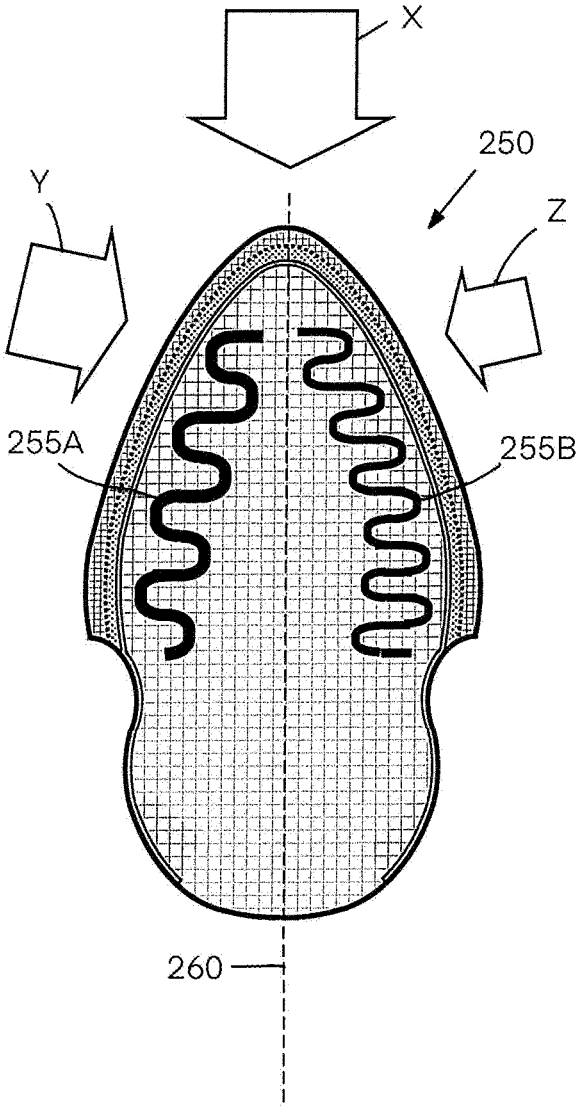
FIG. 9 is a sectional view of the blender of FIG. 7, showing the core component with the asymmetric internal spring structure.

FIGS. 8 and 9 illustrate another variation of blender 250 which is similar to the embodiment of FIGS. 6 and 7. In this variation, the sectional view of FIG. 9 shows an asymmetric spring structure where a plurality of different springs or attached spring elements 255*a*, 255*b* are disposed around the central axis 260 of the blender. These individual spring elements 255*a*, 255*b* are then designed to respond to deflection both axially and transverse to the axis with a plurality of force/deformation characteristics. The number of spring elements can range from 2 to 20 or more. In one variation, as shown in FIG. 9, the asymmetric spring arrangement provides first, second and third selected force/deformation characteristics (X, Y, Z) about the axis 260. Thus, the user can rotate the blender to dab axially or at an angle to the axis to use anyone of three deformation and response characteristics to optimize makeup blending. Thus, the single blender 250 can be used in at least three different vectors depending on the user preference, with arrows X, Y and Z in FIG. 9 indicating different directions of dabbing to provide the desired response characteristics. Graphic indicators such as colors 265 and 266 on the surface of the blender can show the different portions of the blender with different flexing and response characteristics.

Figure 10:
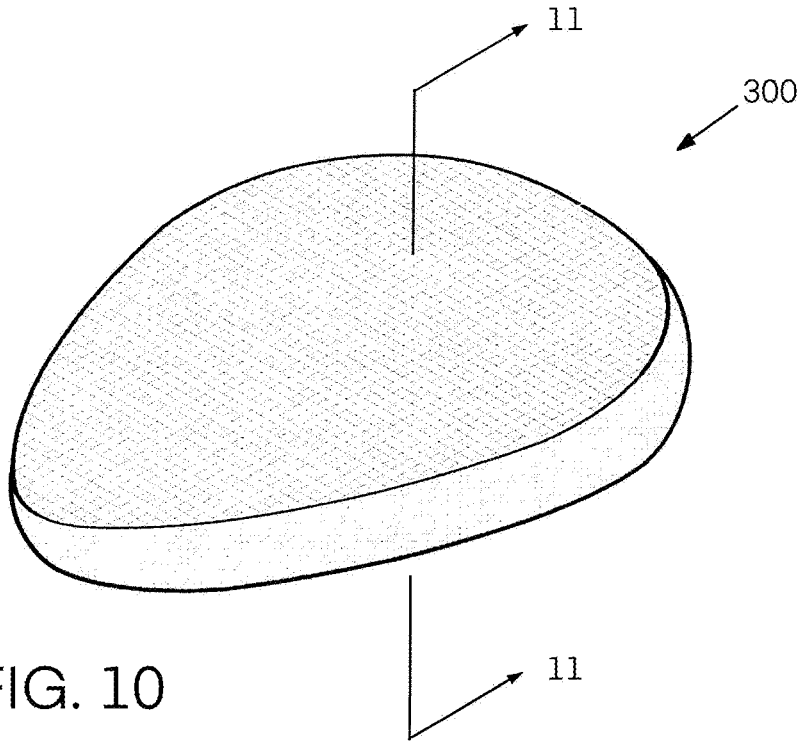
FIG. 10 is a perspective view of another variation of blender having a flattened configuration.
Figure 11:
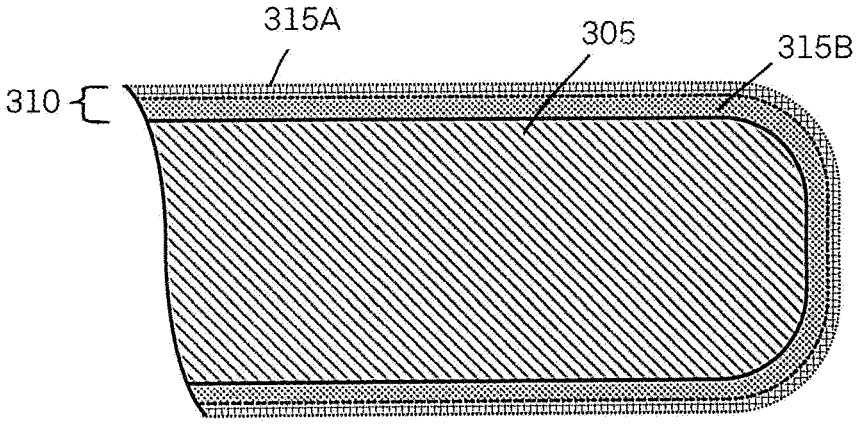
FIG. 11 is a sectional view of the blender of FIG. 10 taken along line 11-11 of FIG. 10 showing a resilient solid core surrounded by a porous surface component having a plurality of layers with differing porosities and surface characteristics, which can be electrospun fibers.

FIGS. 10 and 11 illustrate another variation of blender 300, which consists of a flattened resilient body with surface elements or layers as described in earlier variations above. For example, the blender core 305 (FIG. 11) can be a flexible, nonporous silicone material or the like. The surface component 310 can be detachable or bonded to the blender core 305. In this variation, the surface component 310 again can include a first porosity outer layer 315A and the second different porosity inner layer 315B, for example, a hydrophobic layer as described above. In this variation, the blender 300 again would be easy to clean and dry because of the limited volume of the porous surface layer or layers. In one variation, either or both of layers 315A and 315 of the surface component can comprise electrospun fibers which are formed and adapted to be ultraporous, for example, at least 95% porous, with small fiber diameters, for example with electrospun fibers having a diameter less than 50 μm or less than 20 μm, which are parameters that cannot be provided by conventional memory foams. In one example, electrospun silicone can be used in the form of continuous fibers of chopped fibers mixed with other materials. Examples of electrospun silicones are found in the following articles, which are incorporated herein by this reference: Duan, Gaigai, et. al, "Ultralight, Soft Polymer Sponges by Self-Assembly of Short Electrospun Fibers in Colloidal Dispersions" (https://doi.org/10.1002/adfm.201500001); (2) Haerst, Miriam et al, "Silicone Fiber Electrospinning for Medical Applications" (https://www.degruyter.com/downloadpdf/j/bmte.2014.59.issue-s1/bmt-2014-5000/bmt-2014-5000.pdf.)

In another aspect of the invention, a container can be provided that is adapted for carrying any applicator of FIGS. 4 to 9. Such a container (not shown) can have a plurality of ports therein for allowing airflow into and through the applicator when stored therein. In one variation, the container can have a base portion and a cover portion connected by a hinge that can then be used to clamp the applicator into a collapsed position within the container. It should be appreciated that the container could be similar with the base portion being coupled is a screw-on cap. In another variation, the first container can be provided for a collapsible core portion as shown in FIGS. 4-5B, the second container for carrying a flattened surface portion, which can be flattened sideways. In another aspect of the invention, the container carrying the flattened surface portion can carry a battery operably connected to heating elements therein, such as resistive heaters or LEDs for further speeding the drying process. In another variation, a fan is carried within the container for providing heated airflow through the container to assist in the drying of the applicator. In still another variation, the container can carry LEDs that are configured to provide selected wavelengths of light to illuminate the applicator for various purposes. For example, LEDs with infrared light can be used to heat the applicator to assist in drying or LEDs that provide UV light can be used to sterilizable or otherwise kill bacteria on the surfaces of the applicator.

In general, a cosmetic applicator or blender corresponding to the invention comprises a resilient body shaped for gripping with the fingers of a user, a surface portion of the body comprising a porous memory foam having first inherent rebound characteristics for rebounding from a compressed tensioned shape to a repose memory shape and a core portion of the body comprising at least one spring element imparting to the body second rebound characteristics that differ from the first rebound characteristics inherent in the memory foam. Such a cosmetic applicator is configured with second rebound characteristics that have a faster rebound than the first rebound characteristics. More in particular, such a cosmetic applicator can have second rebound characteristics that are faster than said first rebound characteristics by a factor of at least 1.5 times faster, at least 2 times faster, at least 3 times faster or at least 5 times faster. In this variation, embodiment, the surface portion is typically detachably coupled to the core portion. Further, the interface between the surface portion and the core portion is fluid impermeable.

In general, the cosmetic applicator blender of the invention can be defined as having a ratio between the total interior volume of the surface portion of memory foam relative to the spatial volume of the resilient body is less than 0.4:1, less than 0.3:1, less than 0.2:1 or less than 0.1:1. The at least one spring element can comprise a helical spring or a plurality of other specially shaped spring elements.

In general, a cosmetic applicator or blender corresponding to the invention comprises a resilient body having a central axis adapted and shaped for gripping with the fingers of a user, a surface portion of the body comprising a fluid permeable layer overlying a fluid impermeable layer and an interior portion of the body including at least one spring element for imparting to the body a selected rebound parameter for rebounding the body from a compressed tensioned shape to a de-compressed repose shape. Typically, the plurality of spring elements are spaced apart around the central axis wherein such springs have different spring strength and/or are asymmetrically spaced apart around the central axis.

In general, a cosmetic applicator or blender corresponding to the invention comprises a resilient compressible body having a central axis adapted and shaped for gripping with the fingers of a user, the body having a first compressibility parameter when compressed about the central axis and a second compressibility parameter when compressed at an angle relative to the central axis. In another variation, the body has at least a third compressibility parameter when compressed at a different angle for angles relative to the central axis. Typically, an interior portion of the body carries spring elements for providing the first and second compressibility parameters for additional compressibility parameters. Typically, the spring elements are spaced apart about the central axis of the applicator.

Figure 13:
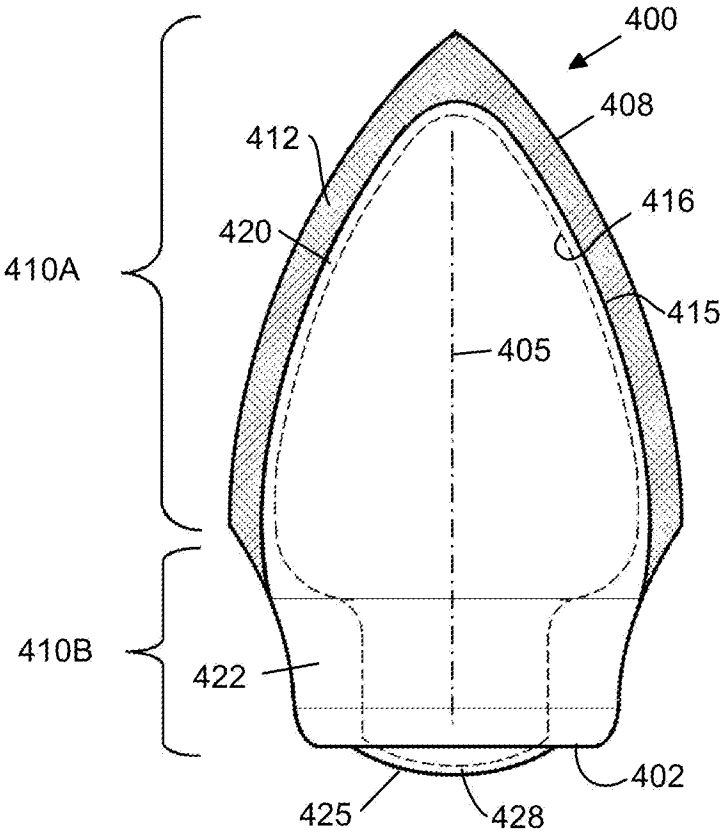
FIG. 13 is a cut-away view of the applicator of FIG. 12 showing a sectional view of the fluid permeable foam surface component.
Figure 12:
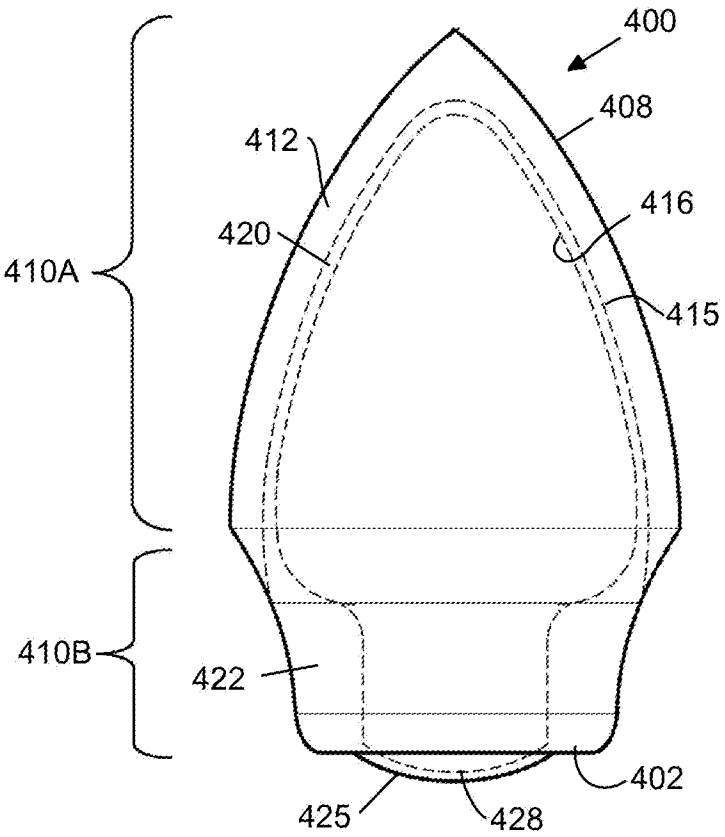
FIG. 12 is an elevational view of a variation of a blender or applicator that has a fluid permeable surface component for contacting tissue around a core portion having an interior sealed interior chamber.
Figure 15:
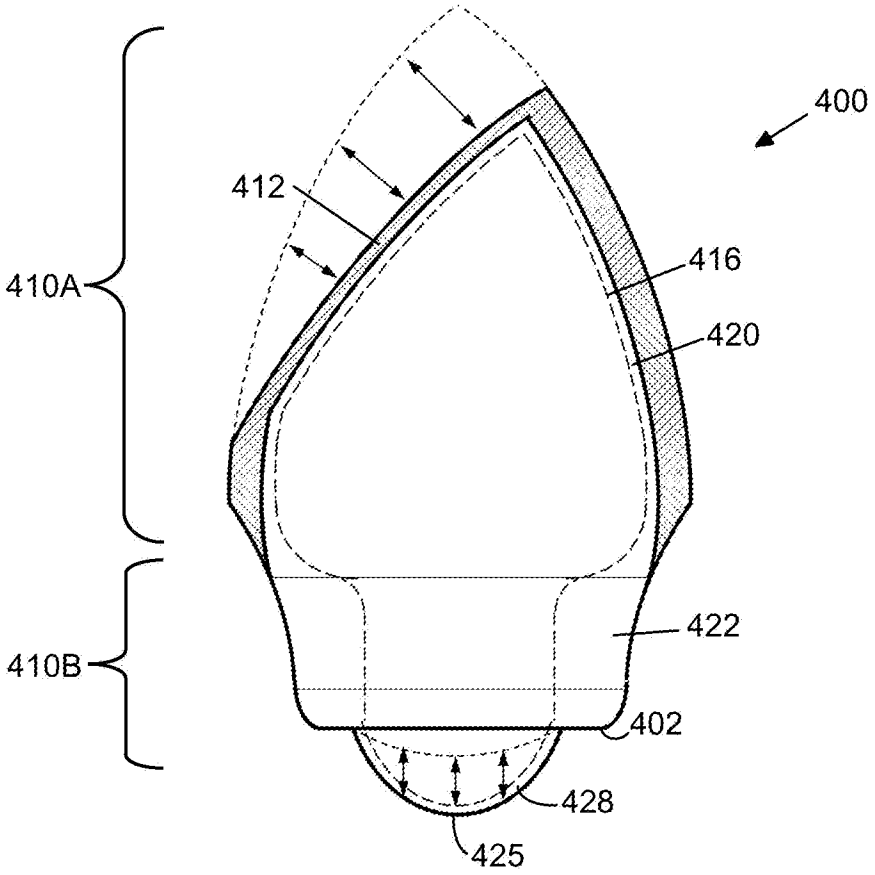
FIG. 15 is a partial sectional view of the cosmetic applicator of FIGS. 12 and 13 being deformed as during use showing the deformation and rebound of the sealed interior chamber and outward bulge of a pressure-modulating mechanism in a base of the applicator.

Now turning to FIGS. 12, 13 and 15, another variation of a cosmetic applicator 400 is shown with a proximal end 402, a central axis 405 and a tapered distal portion 408, although other shapes are possible. The applicator 400 comprises a resilient body that has a skin-contacting portion 410A and a grip portion 410B as shown in FIGS. 12 and 13. The skin-contacting portion 410A includes a fluid permeable surface layer 412 for contacting skin and blending cosmetic products. The surface layer 412 typically is an open-cell foam, and is shown as an integrated component of the applicator 400 in FIGS. 12 and 13 but also may be a removable, disposable member as described in previous variations.

In the variation shown in the elevational view of FIG. 12 and the cut-away view of FIG. 13, a core portion 415 of the applicator includes a pressurizable interior chamber 416 with a relatively thin elastomeric wall 420 extending in 360° around the interior chamber 416 in the skin-contacting portion 410A. The wall 420 is molded in a shape as illustrated in FIGS. 12-13 and is fluid-tight to contains air in the interior chamber although a liquid is also suitable. In the variation of FIGS. 12-13, the wall 420 is shown as being formed of an elastomer, but it should be appreciated that the wall 420 can over-mold reinforcing elements for maintaining a selected repose shape, where such reinforcements can be metal or polymer filaments that are woven or braided, or independent spring elements as described above and below in other variations.

The grip portion 410B of the applicator 400 typically has thicker but resilient, deformable walls 422 around the portion of the interior chamber 416 within the grip portion 410B. The proximal end 402 of the applicator includes an elastomeric pressure-modulating element 425 with elastomeric wall 428 that is adapted to bulge outward and accommodate increased pressure in the interior chamber 416 during use where dabbing deforms the wall 420 around interior chamber 416 in the skin-contacting portion 410A. Thus, it can be understood that overall resiliency of the applicator 400, by which is meant the applicator's surface elasticity or springiness, is provided in a very small part by the foam material of surface layer 412 and is provided primarily by the deformation and rebound characteristics of the wall 420 around the pressurized interior chamber 416 and the elasticity or springiness of wall 428 of the pressure-modulating element 425.

Figure 14:
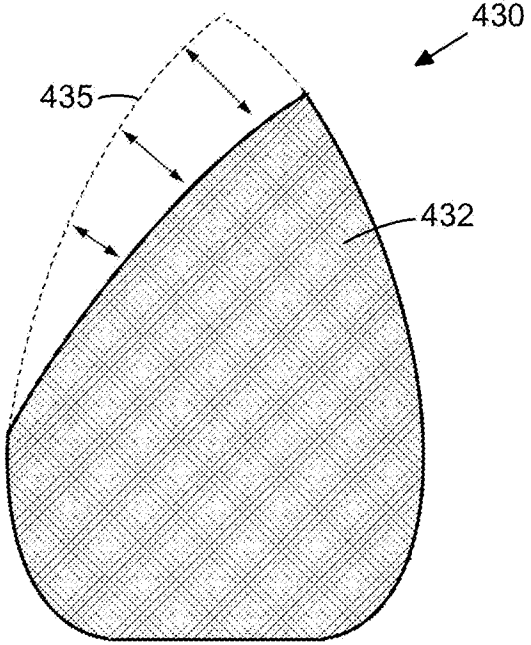
FIG. 14 (PRIOR ART)
FIG. 14 is a sectional view of a prior art foam cosmetic applicator being deformed as during use that indicates compression and rebound vectors.

Now turning to FIGS. 14 and 15, it can be seen how the resilience and rebound characteristics of the applicator 400 of FIG. 12 differs from that of a prior art foam applicator. FIG. 14 is a schematic sectional view of a prior art applicator 430 fabricated of a uniform foam body 432 having a repose profile indicated at 435 with a portion of the foam body being deformed as would occur during dabbing of a cosmetic product on a user's skin. In general, the term resilience means or implies the ability of a body to recover its repose shape quickly after the deforming force or pressure has been removed. Various test methods have been developed to compare resilient materials. One test method defines and determines a parameter called Indentation Force Deflection (IFD) of a foam or other elastic body and is expressed in pounds force per area at a given percent deflection of the foam or other material. Another test method for determines a parameter called Compression Load Deflection (CLD), which is a measure of firmness and is expressed in pounds per square inch (psi) at a given percentage deformation. The test methods typically do not determine the rate at which a deformed surface rebounds from a deformed condition to a repose position. As can be understood from FIG. 14, the rebound characteristic of any foam is quite slow. In contrast, FIG. 15 illustrates the applicator 400 of FIGS. 12-13 being deformed which changes the shape of wall 420, interior chamber 416 and causes a bulge outward of the pressure-modulating element 425. It can be understood that the rebound characteristic of applicator 400 will be very fast as it related to the deformation and rebound of the elastomer in the wall 420 around chamber 416 and wall 428 of the pressure-modulating element 425. Stated another way, the rebound characteristics of applicator 400 differ from that of a foam body 432 (FIG. 14), since the Indentation Force Deflection and Compression Load Deflection parameters of the elastomeric walls 420, 428 interfacing a pressurized chamber 416 are far different from the IFD and CLD parameters of the foam 432 of the prior art applicator 430 of FIG. 14.

Figure 16B:
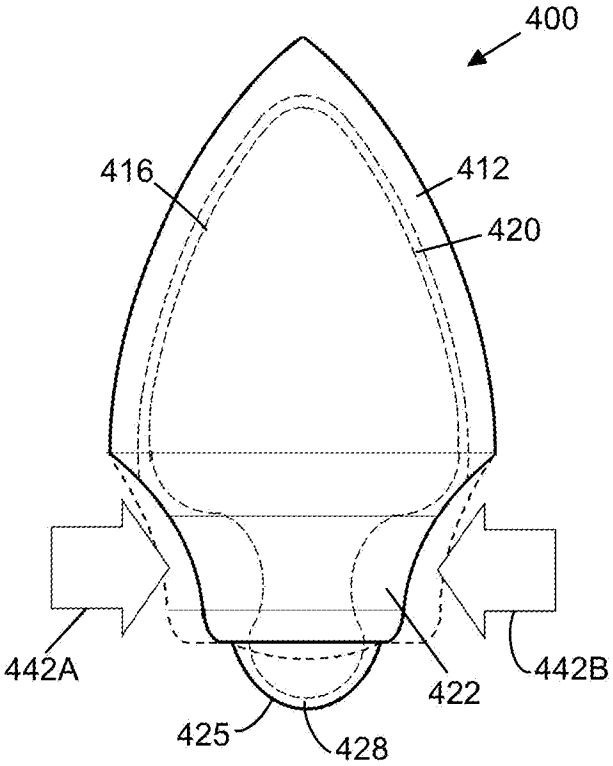
FIG. 16B illustrated the applicator of FIG. 16 with the grip portion after being compressed, thereby increasing the firmness and rebound characteristics of the applicator.
Figure 16A:
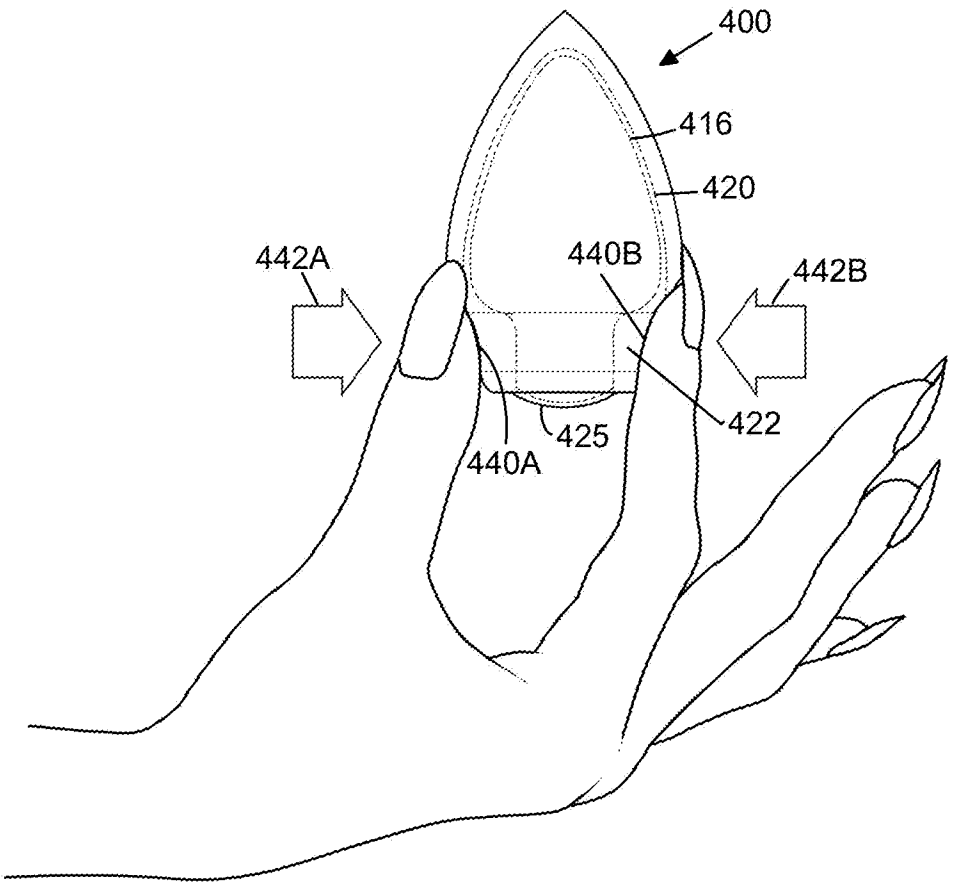
FIG. 16A is a schematic illustration of a user's fingers gripping the grip portion of the cosmetic applicator of FIGS. 12, 13 and 15 preparing to compress the grip portion in a method of the invention to thereby adjust the firmness and/or rebound characteristics of the applicator.

Of particular interest, FIGS. 16A and 16B illustrate another aspect of the applicator 400 of FIGS. 12 and 13. As can be seen in FIG. 16A, the user can grip opposing two sides 440*a* and 440*b* of the grip portion 410B of applicator 400 with the thumb and one or two fingers and squeeze inwardly as indicated by arrows 442*a* and 442*b*, which compress deformable wall 422 of the grip portion 410B and increase the pressure within interior chamber 416. In other words, the user can vary the pressure within the interior chamber and in turn the resiliency, firmness and rebound of the skin-contacting portion 410A "on the fly" during use by applying compressive forces to the grip portion 410B as shown in FIG. 16B. It can be understood that by squeezing the grip portion from opposing sides, the fluid media, such as air, within the interior chamber 416 will cause deformation of pressure-modulating element 425, which is designed to reach a limit of deformation, which then will result in an increase in pressure in the interior chamber 416. As the wall 428 of the pressure-modulating element 425 becomes less compliant under stretching, the increased pressure in the interior chamber 416 will alter the resiliency of the tissue-contacting portion 410A of the applicator, resulting in a firmer applicator with a faster rebound. This aspect of the applicator is advantageous as the user can modulate pressure and rebound characteristics instantly during use, where some facial locations may benefit from a firmer applicator surface layer 412, while other locations, such as around one's eyes, would benefit from a softer resiliency for dabbing cosmetic products.

Figure 17B:
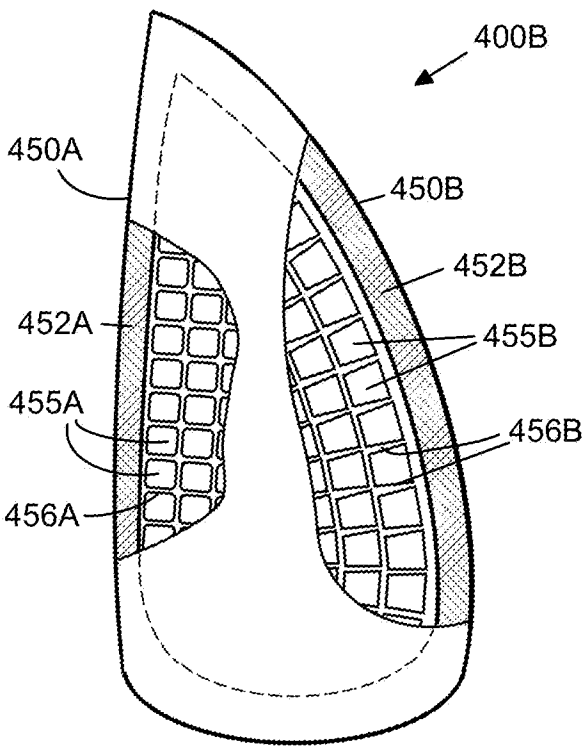
FIG. 17B is a cut-away view of another variation of applicator similar to that of FIG. 17A with an asymmetric shape where opposing skin-contact surfaces have different resiliency and rebound parameters provided different foam thickness and density in surface layers, and different size, wall thickness and orientation of interior chambers.
Figure 17A:
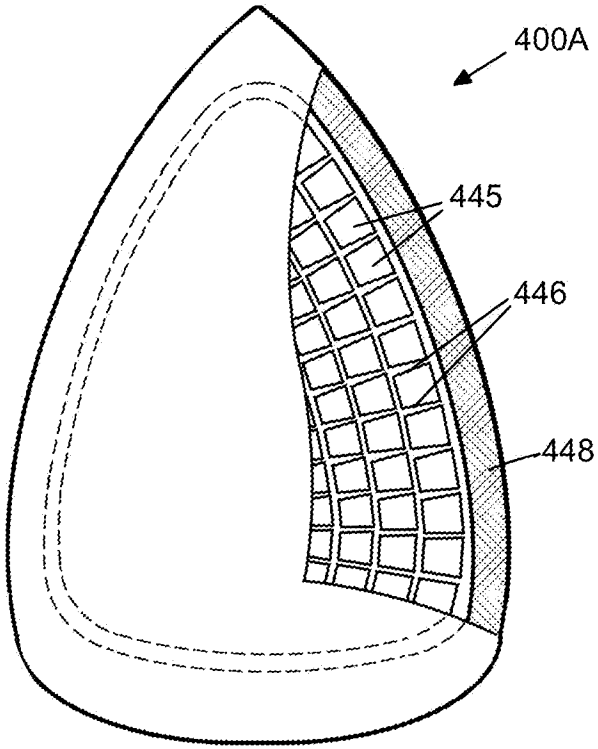
FIG. 17A is a cut-away view of a variation of a blender or applicator that has a fluid permeable surface component for contacting tissue and a core portion configured with a plurality of substantially small interior chambers with thin walls that can be fabricated by 3D printing.

FIG. 17A illustrates another applicator body 400A that is similar to that of FIGS. 12-13 except that the variation of FIG. 17A has a plurality of interior chambers or cells 445 with thin walls 446 that can be designed for a selected resilience. The applicator again is configured with a fluid permeable foam surface layer 448 coupled thereto. In one variation, the applicator body and interior chambers 445 can be fabricated by a 3D printing of silicone or a similar elastomeric material. The dimensions of the chambers 445, wall thicknesses and orientations of the chambers can be modeled and designed to deform and rebound as desired, with or without air flows between the multitude of interior chambers. In one variation, some or all of the chambers or cells 445 have walls with openings therein to provide a molded open cell body. FIG. 17B is a cut-away view of another similar applicator 400B that has an asymmetric shape with opposing surfaces or sides 450A and 450B having different resiliency and rebound parameters. For example, the thickness and porosity of foam 452*a* on side 450A provides a firm surface compared to a thicker, softer, more porous foam 452*b* on side 450B. Similarly, the plurality of interior chambers 455*a* and walls 456*a* on side 450A differ from the chambers 455*b* and thin walls 456*b* on side 450B. In general, a method of the invention includes 3D printing a resilient elastomeric cosmetic applicator adapted for gripping with a human hand, where the interior of the applicator body with an arrangement of multiple interior chambers that are configured to provide selected resiliency and rebound characteristics which can vary from side to side in the applicator body.

Figure 18:
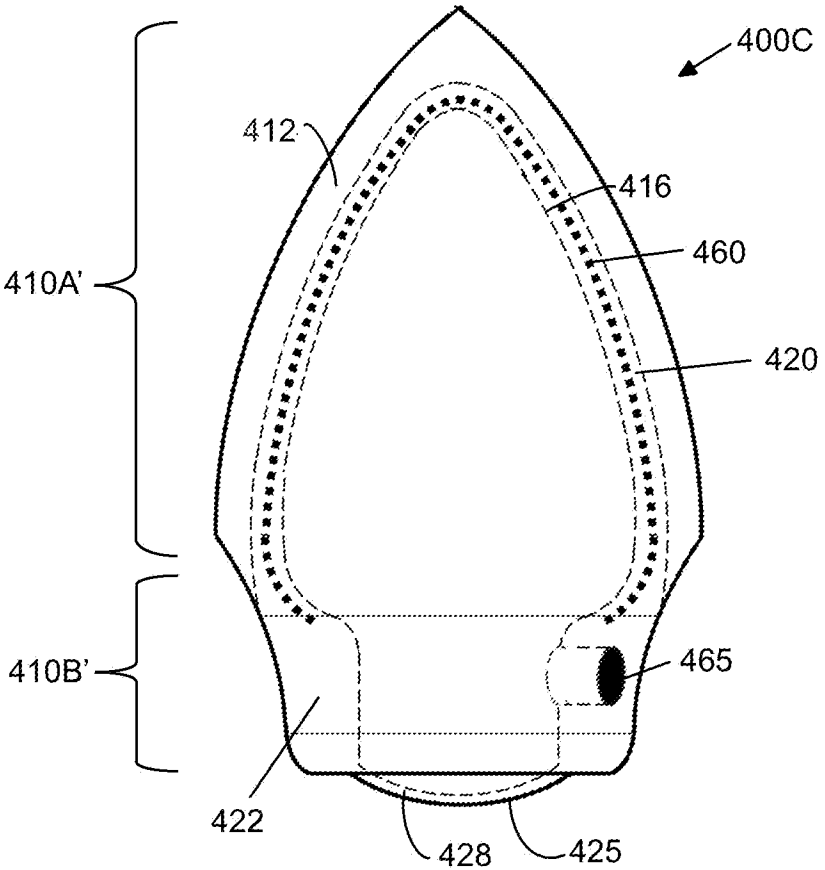
FIG. 18 is a schematic view of a variation of an applicator similar to that of FIGS. 12-13 with a fluid permeable surface component around a core portion with an interior chamber with a surrounding wall that carries a woven or braided spring structure.

FIG. 18 illustrates another applicator 400C that is similar to that of FIGS. 12-13 except that the variation of FIG. 18 includes a woven or braided spring structure 460 or independent spring elements (cf. FIGS. 4, 7 and 9) embedded in the wall 420 of the applicator 400B. In this variation, the spring structure 460 is adapted to provide a significant part of the resilience or rebound characteristic of the applicator portion 410A' together with the pressurizable interior chamber as described above. FIG. 18 also shows an optional feature of the applicator 400B which comprises a vent 465 in the grip portion 410B' of the applicator, which can be covered, uncovered or partly covered by the user's finger or thumb during use. When the user covers the vent 465 with a finger or thumb, the applicator 400C functions as previously described wherein the user can compress the grip portion 410B' to alter the resilience and rebound performance of the applicator. If the user leaves the vent 460 uncovered or partly covered, then the resilience of the applicator will depend on only the springiness of the spring structure 455. This feature provides the user with a further option for varying the resilience and rebound characteristics of the applicator during use. In other words, the user can fine tune the responsiveness and rebound characteristics in a continuum between three modes: (i) relying on the inherent springiness of the surface foam layer 412 and the spring structure 460; (ii) the foregoing plus pressure from the interior chamber 416 when the vent 465 is closed or partially closed with the user's finger; and (iii) the foregoing plus added pressurization in interior chamber from closing the vent 465 and compressing together the walls 422 of the grip portion 410B.

Figure 20:
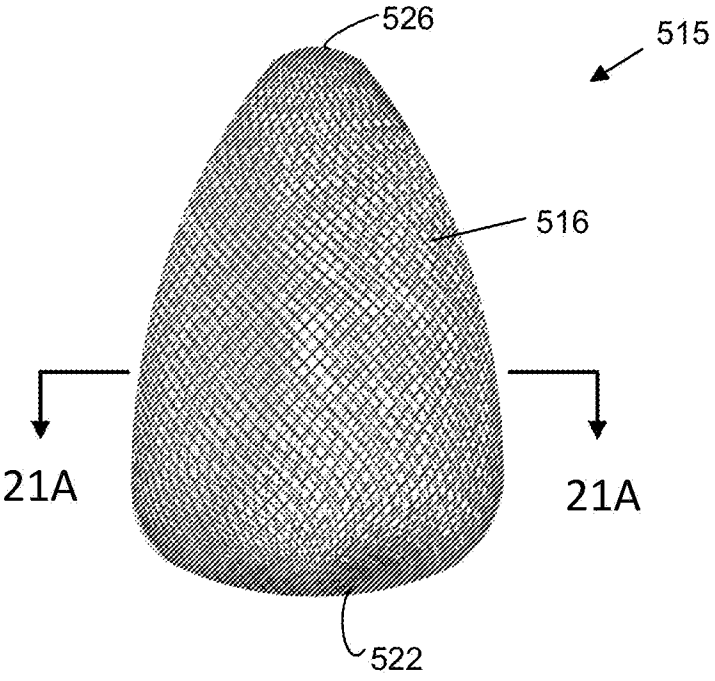
FIG. 20 is an elevational view of the core component of FIG. 19, which comprises a woven or braided structure fabricated of a metal wire such as a nickel titanium alloy, a stainless steel, a polymeric material or a combination thereof.
Figure 19:
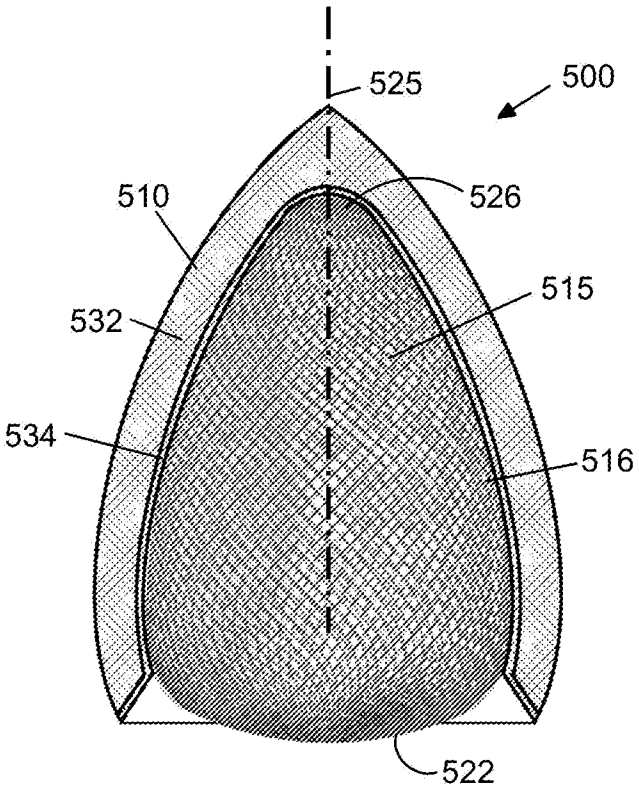
FIG. 19 is a partial sectional view of a variation of a blender or applicator that has a fluid permeable surface component for contacting tissue that is removable from a core component that comprises a woven or braided spring structure.

Now turning to FIGS. 19 and 20, another variation of a cosmetic applicator 500 is shown, which comprises a resilient body that includes a fluid permeable surface component 510 for contacting tissue as described previously that is removable from a core component 515. In the illustration of the applicator in FIG. 19, the core component 515 comprises a spring structure 516, which in one variation is a braided or woven material consisting of metal spring-like wires or filaments such as Nitinol, stainless steel, or the like. In other variations, the spring structure 516 can have larger diameter wires to form a cage or stent-like configuration with a spring force built therein. In another variation, the spring structure 516 can be an entangled wire filament or filaments and may not have an open interior. In FIG. 19, it can be seen that the braided wire spring structure 516 of the core component 515 extends from the proximal end 522 about a central axis 525 to distal tip 526 with the component being tapered in the distal direction. The wire filaments can have any suitable diameter in braided, woven, cage-like structures, or entangled filament structures, for example, ranging from 0.001" to 0.010" in diameter to provide a suitable outward spring force when coupled with the fluid permeable outer surface component 510. In other words, the spring force inherent in the core component is designed to provide the optimal rebound characteristics so the applicator body rebounds from any compressed shape of the structure to its repose shape during use as described above.

FIG. 20 shows the core component 515 of FIG. 19 without the outer fluid permeable surface component 510 coupled thereto. Thus, it can be seen in FIG. 20 that the spring structure 516 comprises bare braided or woven wires, but also may be coated wires or filaments, or a combination of wire and polymer filaments. Referring back to FIG. 19, the removable outer surface component includes an outer portion comprising a fluid permeable open cell foam 532 with a thin, fluid impermeable inner layer 534 configured to prevent fluid migration through the component 510 into contact with the core component 515.

Figure 21B:
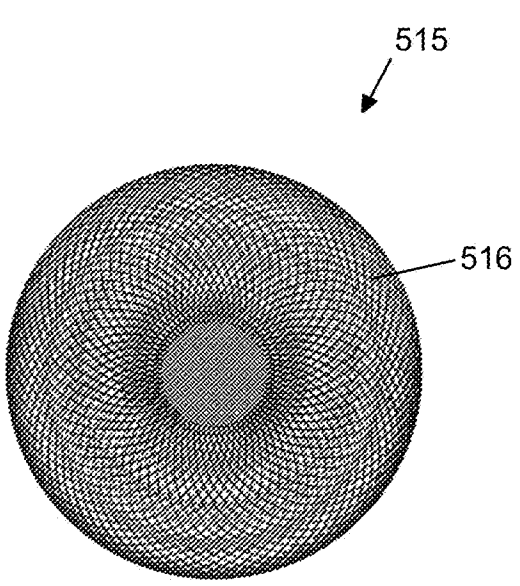
FIG. 21B is an end view of the core component of FIG. 20.
Figure 21A:
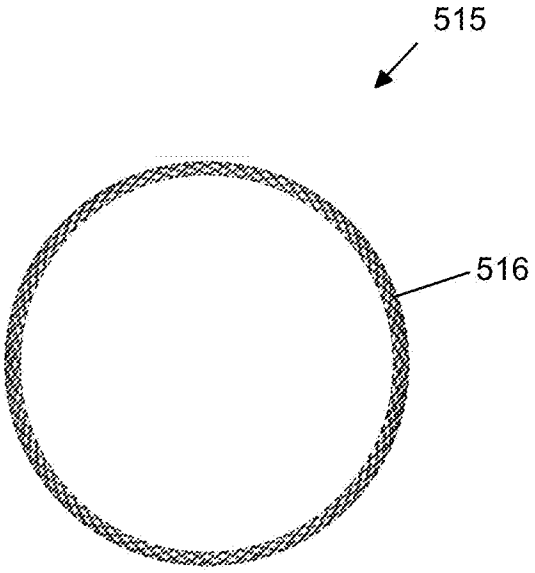
FIG. 21A is a sectional view of the core component of FIG. 20 taken along line 21A-21A of FIG. 20.

Referring to FIG. 20 and the end view of FIG. 21B, the woven or braided spring structure 516 may have an open proximal end and/or an open distal end that can be left open or closed with a crimping element or similar element (not shown) to close the opening. FIG. 21A shows a transverse sectional view of the core component of FIG. 20 where the wire structure 516 is shown as a single layer of a braided or woven material. In other variations, multiple layers of a braided or woven structure are possible.

Figure 22:
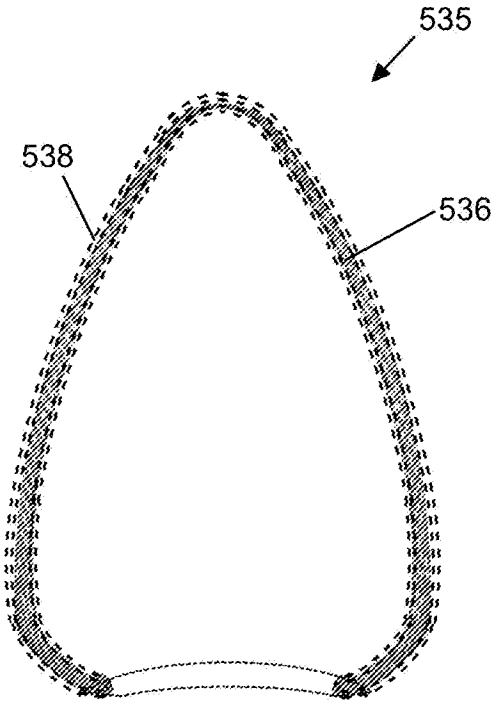
FIG. 22 is a sectional view of a core component again comprising a woven or braided metal spring structure, where in this variation the component has an open proximal end for receiving a user's fingers and where the spring structure is coated with flexible polymeric material making the walls of the structure fluid impermeable.

Now turning to FIG. 22, another variation of a core component 535 is shown where the braided metal structure 536 is similar to that of FIG. 20, except the component 535 is coated with an impermeable, elastomeric material 538 to protect the wire structure from contact with moisture. As an example, the braided wire structure 536 may be dip-coated with a thin layer of low modulus silicone or another similar polymer. In this variation, the removable outer surface component (not shown) can be similar to that of FIG. 19 but does not need to carry a fluid impermeable layer 534 as in FIG. 19 to prevent moisture from contacting the spring structure 536. Thus, a fluid impermeable membrane is useful between a tissue-contacting surface component 510 (FIG. 19) and a core component 515 or 535 (FIG. 19, FIG. 22) but such a fluid impermeable layer can be disposed on either an inner surface of the surface component or an outer surface of the core component.

Figure 23:
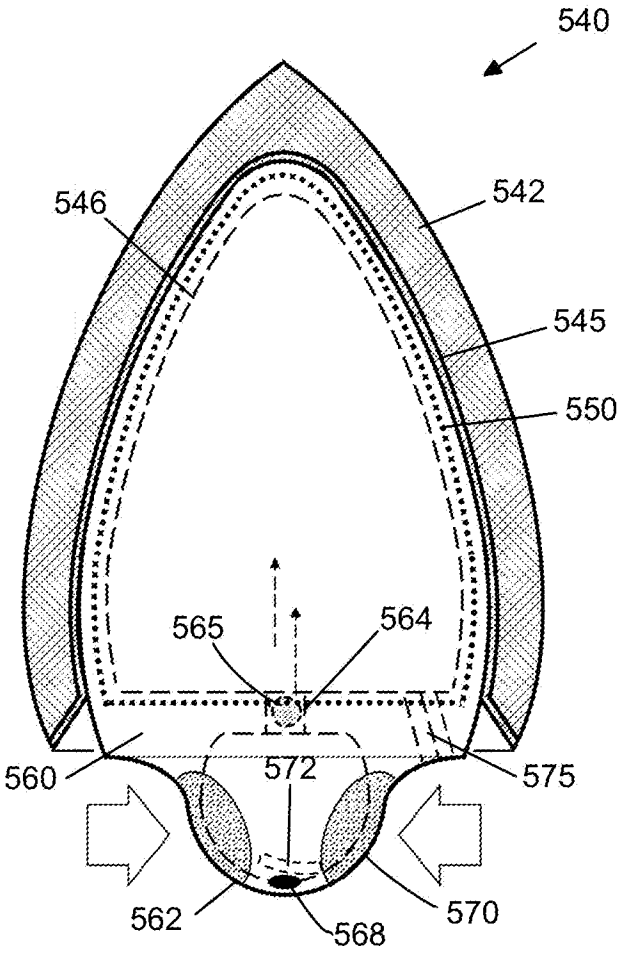
FIG. 23 is a partial sectional view of another variation of cosmetic applicator again including a removable fluid permeable surface component and a core component that comprises a body with an inflatable interior chamber together with a squeeze bulb for increasing the fluid pressure within the interior chamber.

FIG. 23 shows another variation of a cosmetic applicator 540 again comprising a removable fluid-permeable surface component 542 and a resilient core component 545. In this variation, the core component 545 includes an inflatable interior chamber 546 where the walls 548 surrounding such an interior chamber 546 comprise a non-porous polymer. Typically, the walls 548 would include a spring structure 550 embedded therein. However, it should be appreciated the core component 545 and walls 548 thereof can be formed, when inflated, to have rebound characteristics that cooperate with the tissue-contacting surface component 542 to allow suitable compression and de-compression during use. In such a variation, the core component can have features in a proximal base portion 560 that deform or bulge outwardly during use to provide a suitable rebound characteristic to the tissue contacting surface component during use.

In the variation of FIG. 23, the base portion 560 if core component 545 is configured with a pressurization mechanism for inflating or increasing the pressure within the interior chamber 546. As can be seen in FIG. 23, a squeeze bulb 562 is provided as a form of pump that is adapted to pump air through a channel 564 and check valve 565 into the interior chamber 546. It can be appreciated that a limited number of actuations of the squeeze bulb 562 would change the interior pressure in the core component 545, which would in turn alter the rebound characteristics of the component when combined with the fluid permeable outer component 542 as described above. In this variation, there is a vent 568 that allows air to enter the squeeze bulb chamber 570 which typically carries another one-way valve or flap valve 572 as can be understood in the field of such squeeze bulbs. In this variation, a pressure release mechanism 575 also is provided in the base portion 560 of core component 545 for deflating or decreasing the pressure within the interior chamber 546. Such a pressure release mechanism can comprise a slit in an elastomeric material that has a normally closed, repose position where the slit is collapsed. Such a pressure release slit 577 can be opened slightly by manual pressure toward opposing ends of the slit 577 as is known in the art. By this means, the user can release air from the interior chamber 546 in the event that the user finds interior pressures too high, and the system thus allows for adjustment of the rebound parameters or characteristics of the applicator. In another aspect of the invention, the core component 545 can be entirely deflated and thus the core component can be flattened for reducing its volume to carry in a small, flat carrying case.

Figure 25:
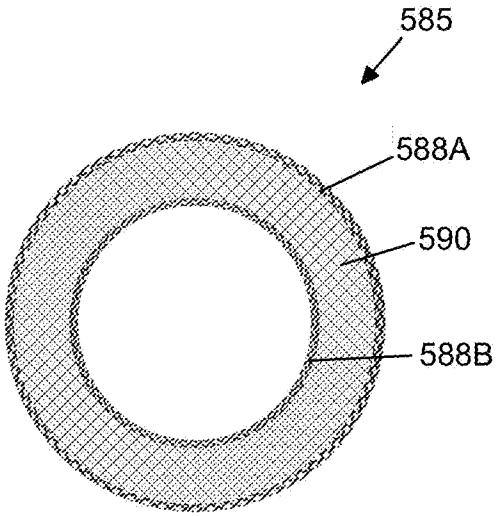
FIG. 25 is a sectional view of the core component of FIG. 24 taken along line 25-25 of FIG. 24.
Figure 24:
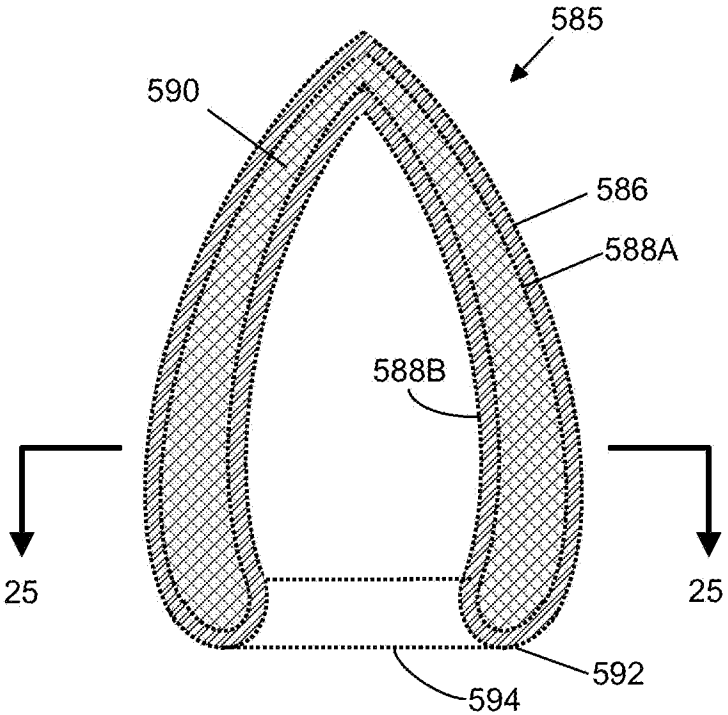
FIG. 24 is a sectional view of another variation of a core component of a cosmetic applicator with inner and outer layers of a woven or braided spring structure with a resilient foam material disposed between the layers of the spring structure.

FIG. 24 illustrates other variations of a core component 585, which again includes a woven braided wire spring structure 586. In this variation, the spring structure 586 has an outer woven layer 588*a* and an inner woven layer 588*b*, which provides added resiliency for a particular applicator core component 585. In one variation, a foam material 590 is disposed intermediate the outer layer 588*a* and the inner layer 588*b* as shown in FIGS. 24 and 25. As also can be seen in FIG. 24, the proximal end 592 of the core component 585 has an opening 594 that is adapted for the insertion of at least one of the user's fingers, and typically is dimensioned for two fingers, which then allows use of the core component (and surface component) by inserting one's fingers into the applicator and then dabbing cosmetics with finger movements rather than wrist movements as in typical variations of applicators described herein. Such an applicator body thus can be used either by finger movements or gripped with one's fingers and dabbed with wrist movements.

Figure 26:
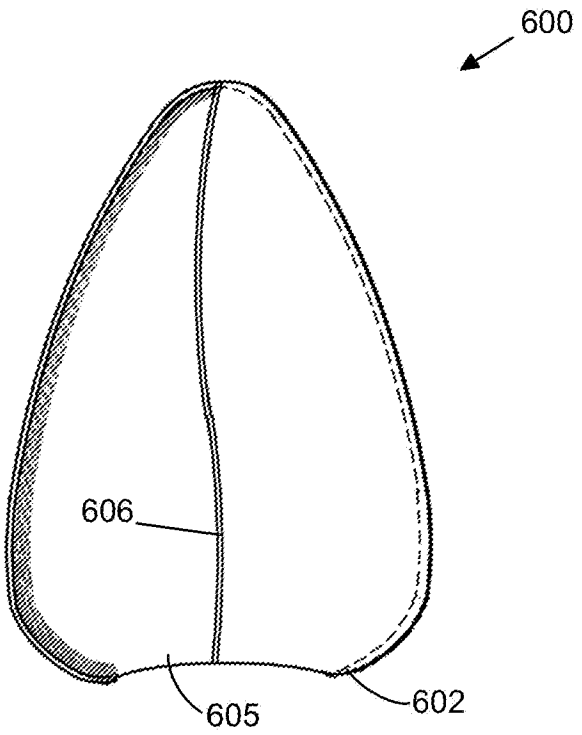
FIG. 26 is a cut-away view of a thin wall fluid-impermeable sleeve that can be coupled to a core component of FIG. 20 or 24.

FIG. 26 shows a thin wall fluid-impermeable sleeve 600 with a proximal end 602 with an opening 605 therein where the sleeve 600 and thin wall 606 is dimensioned to fit over a core component, such as the core components 515 and 585 of FIGS. 20 and 24, respectively, to provide a fluid-impermeable layer. In other words, a fluid-impermeable layer for preventing migration of fluids through a fluid permeable outer component can be provided as a separate thin film sleeve 600 instead of being a feature of the outer tissue-contacting surface component or a feature of the core component.

Figure 28:
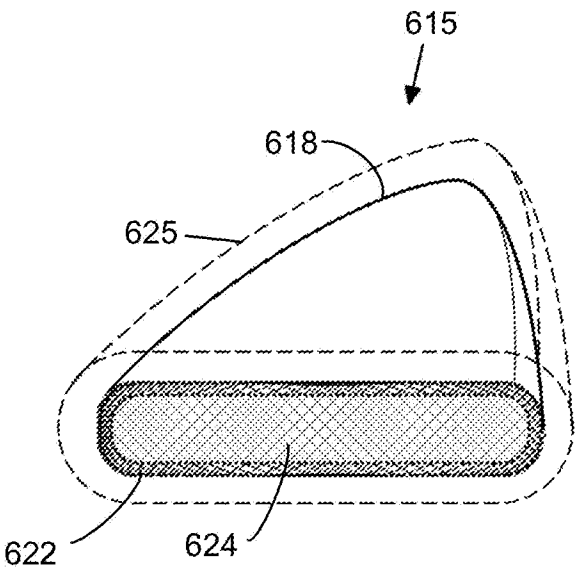
FIG. 28 is a sectional view of the core component of FIG. 27 taken along line 28-28 of FIG. 27, showing a fluid permeable surface component in phantom view and further showing the spring structure and resilient foam interior portion.
Figure 27:
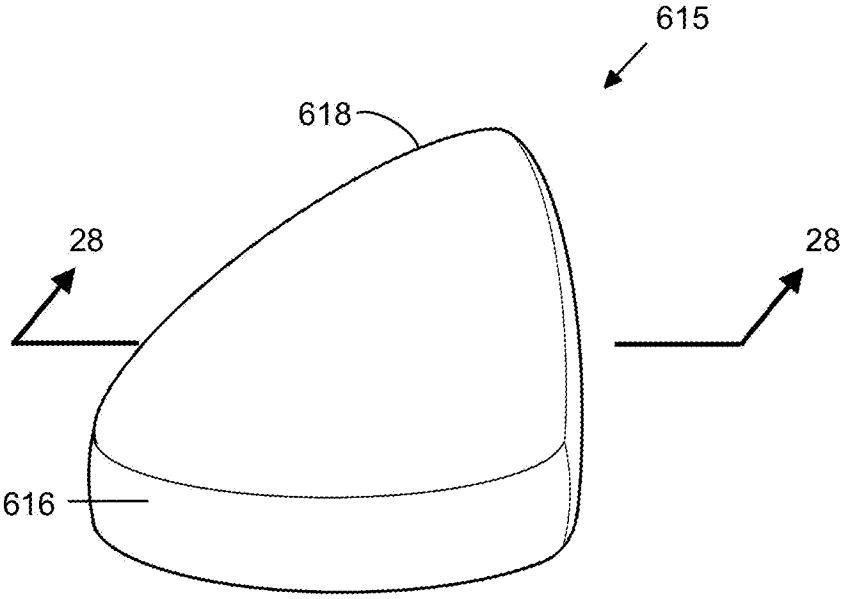
FIG. 27 is a perspective view of a core component with a flattened shape that has a woven or braided spring structure bonded to a resilient foam core.

FIGS. 27 and 28 show another variation of a core component 615 of a cosmetic applicator which has a flattened shape extending from proximal end 616 to a tapered distal portion 618. In this variation, as can be seen in sectional view of FIG. 28, the core component 615 again comprises a woven material formed as a spring structure 622 that is flattened and bonded to an interior foam core 624. In FIG. 28, the outer tissue-contacting surface component 625 is shown in a dashed line that is similar to the previous variations above.

Figure 29:
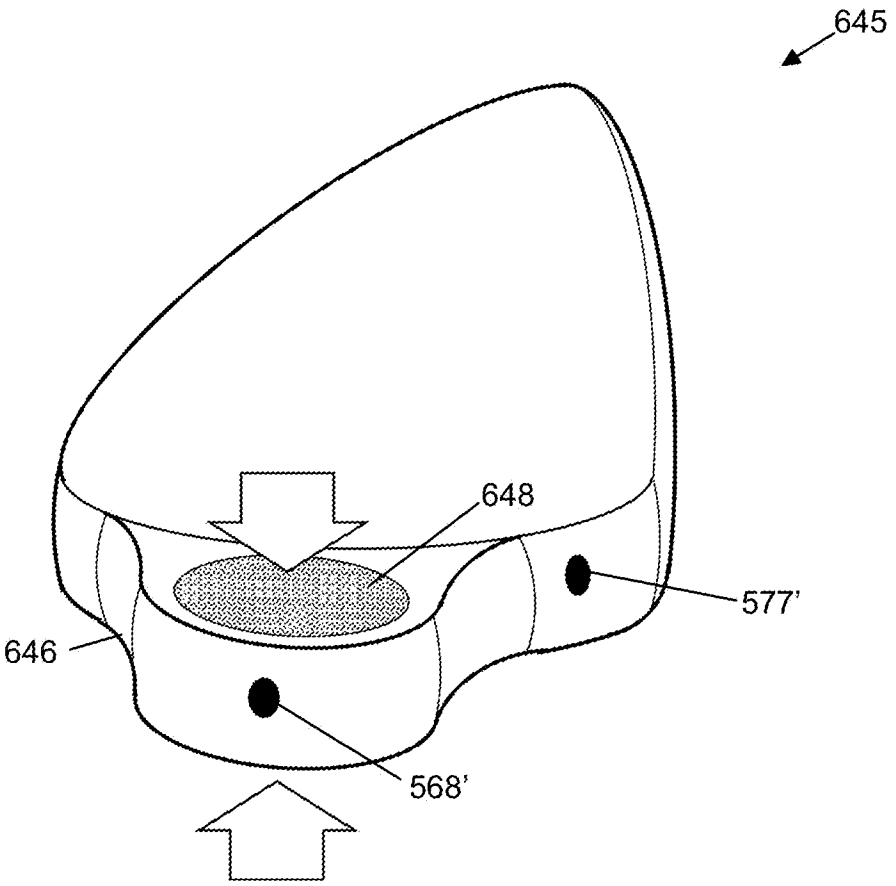
FIG. 29 is a perspective view of another variation of core portion of a cosmetic applicator having a form similar to that of FIG. 27 with proximal portion carrying a squeeze bulb adapted for inflating a plurality of interior chambers therein.
Figure 30B:
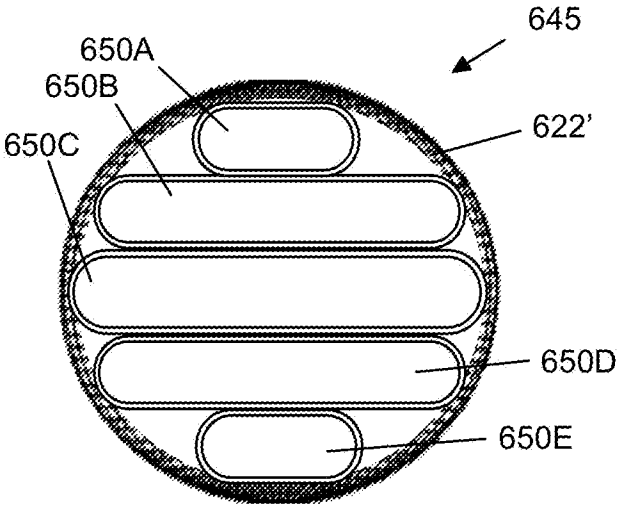
FIG. 30B is a sectional view of the component of FIG. 30A showing the inflatable sections in inflated positions that are adapted to change the shape of the core component from a flattened shape to a rounded shape and also alter its rebound characteristics.
Figure 30A:
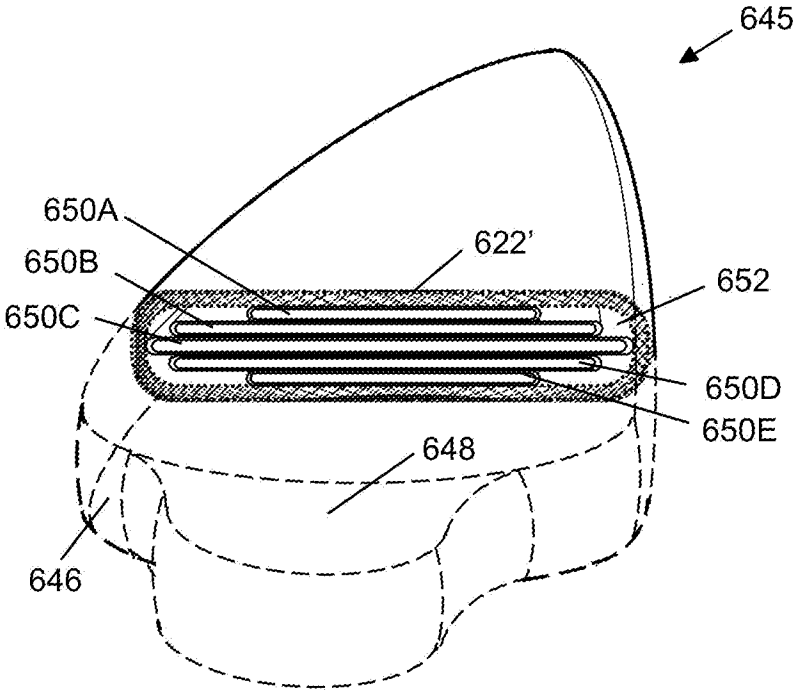
FIG. 30A is a sectional view of the core component of FIG. 29 showing the interior of the component carrying an inflatable structure with a plurality of inflatable sections or chambers in a collapsed position.

Now turning to FIGS. 29 and 30A, another variation of an applicator core component 645 is shown which has a flattened shape with a proximal end 646 carrying a squeeze bulb 648 as described in the previous variation of FIG. 23. This variation again carried the spring structure 622' as in the variation of FIGS. 27-28. In this variation, the squeeze bulb 648 is adapted to inflate a plurality of interior chambers 650*a*-650*e* within the core component 645 which in turn is adapted to change the shape of the core component (FIG. 30A). In other words, the inflation mechanism is not only adapted to change the rebound characteristics of the applicator, but also can be used to change the shape of the applicator. In previous variations, it has been described how different flattened shapes or rounded, conical shaped applicators may be suitable for different uses in applying cosmetic products. In FIG. 30A, which is a sectional view of the core component 645 of FIG. 29, it can be seen that an interior space 652 of the core component 645 carries the plurality of inflatable chambers 650*a*-650*e* within non-distensible walls 655 such that expansion of the chambers 650*a*-650*e* will change the cross-sectional shape of the core component 645. As an example, the variation of FIGS. 30A and 30B show the expansion or inflation of five interior chambers 650*a*-650*e* by use of the squeeze bulb 648 of FIG. 29 to alter the flattened shape of FIG. 30A to the rounded cross-sectional shape of FIG. 30B. The variation of FIG. 29 carries a vent 568' and pressure release slit 577' similar to the squeeze bulb variation of FIG. 23.

Thus, the variations of FIGS. 23, 29, 30A and 30B illustrate how inflation chambers in the core component can be used for altering the rebound characteristics of a core components and/or for changing the shape of such a core component. It can be appreciated that another multiple inflation chamber design can be used in different configurations to elongate the core component as well as for changing the transverse sectional shape of the core component.

Figure 31:
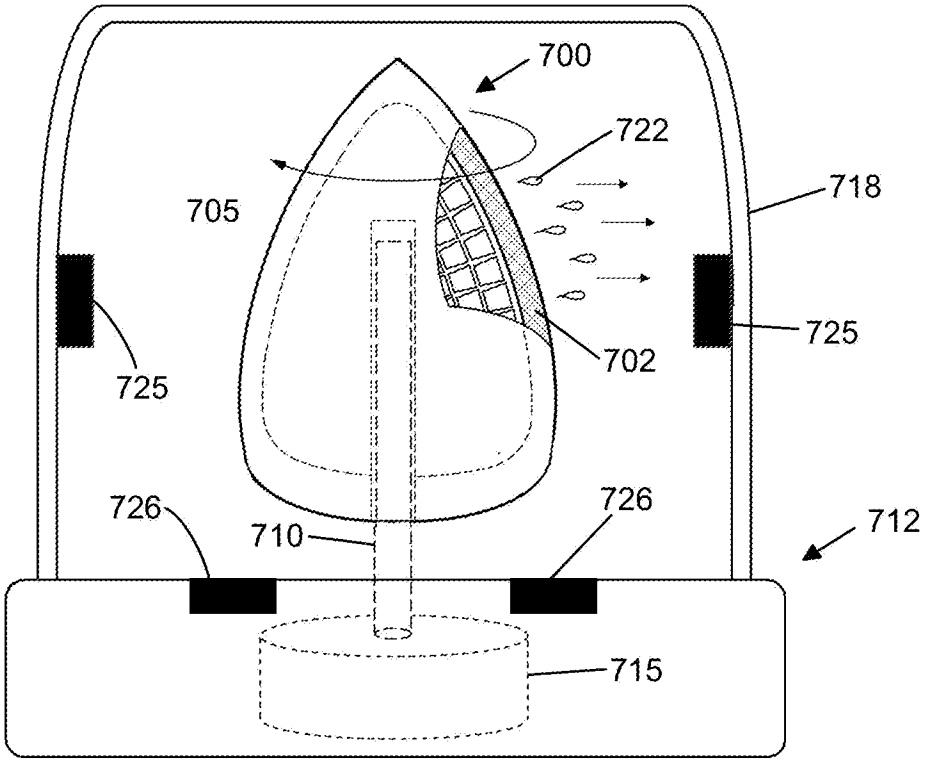
FIG. 31 is a schematic view of another component of the invention comprising a base module or console adapted to spin dry and disinfect an applicator of the types shown in FIGS. 12, 17A-17B and 18.

FIG. 31 schematically illustrates another aspect of the invention which relates to a device for ensuring that an applicator can be easily cleaned and dried. The applicators of FIGS. 12, 17A, 17B and 18 are configured with an attached, thin foam surface layer for contacting skin. Since such a fluid permeable layer is thin (unlike a prior art foam applicator of FIG. 14), it is possible to wash the surface layer and remove cosmetic products from the foam layer. It is less clear whether bacteria and other living organisms can be completely removed by washing, and particularly without immediate drying of a just-washed applicator. In FIG. 31, it can be seen that an applicator 700 with a fluid permeable surface layer 702 is provided with a central elongated opening 705 that is adapted to fit over a motor driven shaft 710. FIG. 31 shows a base module 712 carrying a motor 715 that can rotate shaft 710 at high speed, e.g., from 100 rpm to 10,000 rpm. The opening 705 in the applicator 700 is dimensioned to provide engagement with shaft 710 to provide for high-speed rotation and spin-drying of the applicator 700. The base module 712 can carry a transparent plastic cover 718. After using the applicator 700, the user washes the applicator and then places the applicator on shaft 710 and actuates the motor 715 to rotate the shaft 710 and applicator where centrifugal forces will quickly remove water in the form of droplets 722 from the applicator. In order to dry the applicator and disinfect the applicator, the base module and/or the walls of the cover 718 carry heating and UV mechanisms. The heating mechanism can consist of resistive heaters or any other suitable type of heater and is shown as infrared LEDs 725. The mechanism to kill bacteria and other pathogen can consist of one or more LEDs 726 emitting UV light. It should be appreciated that the base module 712 can be provided with controller adapted to control the time interval for spinning the applicator, for heating the applicator and for controlling the UV light. It should be further appreciated that if the applicator 700 is symmetric about its axis, then the elongated opening 705 will be along the centerline of the applicator. If the applicator has an asymmetric configuration as in the variation of FIG. 17B, then the elongated opening 705 will be configured so that the applicator is rotationally balanced about the shaft 710.

Although particular embodiments of the present invention have been described above in detail, it will be understood that this description is merely for purposes of illustration and the above description of the invention is not exhaustive. Specific features of the invention are shown in some drawings and not in others, and this is for convenience only and any feature may be combined with another in accordance with the invention.

Although particular embodiments of the present invention have been described above in detail, it will be understood that this description is merely for purposes of illustration and the above description of the invention is not exhaustive. Specific features of the invention are shown in some drawings and not in others, and this is for convenience only and any feature may be combined with another in accordance with the invention. A number of variations and alternatives will be apparent to one having ordinary skills in the art. Such alternatives and variations are intended to be included within the scope of the claims. Particular features that are presented in dependent claims can be combined and fall within the scope of the invention. The invention also encompasses embodiments as if dependent claims were alternatively written in a multiple dependent claim format with reference to other independent claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

All references, including publications, patent applications, and patents, cited herein are hereby incorporated by reference to the same extent as if each reference were individually and specifically indicated to be incorporated by reference and were set forth in its entirety herein.

What is claimed is:

1. A cosmetic applicator comprising:

a resilient body having a skin-contacting portion and a grip-portion shaped for gripping by a user, where the grip-portion comprises a deformable wall having a thickness greater than a wall of the skin-contacting portion;

a surface portion of the resilient body comprising a fluid permeable material;

an interior elastomeric wall within the resilient body, the interior elastomeric wall defining an interior chamber; and a pressure modulating surface located adjacent to the grip-portion opposite to the resilient body configured to deform away from the resilient body, the pressure modulating surface having a deformation limit;

wherein compression of the grip-portion by a user of the cosmetic applicator increases a pressure of the interior chamber causing deformation of the pressure modulating surface until the pressure modulating surface deforms to the deformation limit causing an increase a pressure in the interior chamber resulting in altering a resiliency of the skin-contacting portion such that a firmness and a rebound rate of the skin-contacting portion increases.

2. The cosmetic applicator of claim 1, further comprising a spring structure in the resilient body.

3. The cosmetic applicator of claim 2, wherein the spring structure comprises a metal material.

4. The cosmetic applicator of claim 2, wherein the spring structure comprises a NiTi material.

5. The cosmetic applicator of claim 2, wherein the spring structure comprises a polymer.

6. The cosmetic applicator of claim 2, further comprising a fluid impermeable layer intermediate the surface portion and the interior elastomeric wall.

7. The cosmetic applicator of claim 6, where the surface portion is removable from the interior elastomeric wall.

8. The cosmetic applicator of claim 7, where the fluid impermeable layer is carried by the surface portion.

9. A cosmetic applicator comprising:

a resilient applicator body comprising a surface portion and a grip-portion adapted for gripping by a user, where the grip-portion is axially spaced from the surface portion;

the surface portion of the resilient applicator body comprising a fluid permeable resilient foam material adapted for tissue contact;

an elastomeric wall within the resilient applicator body and defining at least one interior chamber; and where the grip-portion of the resilient applicator body is configured for inward compression by a user causing the elastomeric wall adjacent to the grip-portion to alter a pressure of the at least one interior chamber to thereby adjust compressibility and rebound characteristics of the resilient applicator body.

10. The cosmetic applicator of claim 9, further comprising a pressure modulating surface located adjacent to the grip-portion opposite to the resilient applicator body and configured to deform away from the resilient applicator body, the pressure modulating surface having a deformation limit.

11. The cosmetic applicator of claim 10, wherein compression of the grip-portion by the user increases a pressure of the at least one interior chamber causing deformation of the pressure modulating surface until the pressure modulating surface deforms to the deformation limit causing an increase a pressure in the at least one interior chamber resulting in altering a resiliency of the surface portion such that a firmness and a rebound rate of the surface portion increases.

12. The cosmetic applicator of claim 9, where the elastomeric wall defines a plurality of interior chambers.

13. The cosmetic applicator of claim 12, where the plurality of interior chambers includes at least one chamber in fluid communication with an adjacent chamber.

14. The cosmetic applicator of claim 12, where the plurality of interior chambers are arranged symmetrically relative to the surface portion of the resilient applicator body adapted for tissue contact.

15. The cosmetic applicator of claim 12, where the plurality of interior chambers are arranged asymmetrically relative to the surface portion of the resilient applicator body adapted for tissue contact.

16. The cosmetic applicator of claim 9, where the surface portion has uniform properties around the surface portion of the resilient applicator body adapted for tissue contact.

17. The cosmetic applicator of claim 9, where the surface portion has non-uniform properties around the surface portion of the resilient applicator body adapted for tissue contact.

18. The cosmetic applicator of claim 9, wherein a wall of the grip-portion is thicker than a wall of the surface portion.

* * * * *